US009008933B2

(12) United States Patent
Cooper et al.

(10) Patent No.: US 9,008,933 B2
(45) Date of Patent: Apr. 14, 2015

(54) OFF-BOARD SCHEDULING SYSTEM AND METHOD FOR ADJUSTING A MOVEMENT PLAN OF A TRANSPORTATION NETWORK

(75) Inventors: Jared Cooper, Melbourne, FL (US); Mitchell Scott Wills, Melbourne, FL (US); Kevin Campbell, Melbourne, FL (US); John McElroy, Melbourne, FL (US); Jian Li, Melbourne, FL (US); Bruce Hancock, Melbourne, FL (US); Sherri Boyd, Melbourne, FL (US); Mason Samuels, Melbourne, FL (US); Paul Denton, Atlanta, GA (US); David Eldredge, Melbourne, FL (US); Scott Dulmage, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 110 days.

(21) Appl. No.: 13/307,553

(22) Filed: Nov. 30, 2011

(65) Prior Publication Data

US 2012/0290182 A1 Nov. 15, 2012

Related U.S. Application Data

(60) Provisional application No. 61/483,988, filed on May 9, 2011.

(51) Int. Cl.
*G08G 9/00* (2006.01)
*G06F 7/00* (2006.01)
(Continued)

(52) U.S. Cl.
CPC ..... *B61L 23/32* (2013.01); *B61L 27/0027* (2013.01)

(58) Field of Classification Search
CPC ..... B61L 23/32; B61L 27/0027
USPC ..... 701/70, 118
See application file for complete search history.

(56) References Cited

U.S. PATENT DOCUMENTS 6,873,962 B1 * 3/2005 Doner ..... 705/7.22
7,395,141 B1 7/2008 Seck et al.
(Continued)

FOREIGN PATENT DOCUMENTS

EP 1754644 A1 2/2007

OTHER PUBLICATIONS

Search Report and Written Opinion from corresponding PCT Application No. PCT/US2012/036486 dated Sep. 28, 2012.

*Primary Examiner* — Calvin Cheung
*Assistant Examiner* — Yazan A Soofi
(74) *Attorney, Agent, or Firm* — GE Global Patent Operation; John A. Kramer

(57) ABSTRACT

A system includes a monitoring module, a congestion module, a modification module, and a communication module. The monitoring module monitors vehicles in a transportation network. The congestion module calculates a throughput parameter that is representative of a statistical measure of adherence to a movement plan by the vehicles. The modification module determines a confidence parameter representative of a probability that changing the original meet event does not reduce the throughput parameter. The modification module modifies the original meet event to an updated meet event when the confidence parameter exceeds a predetermined threshold. The communication module transmits the updated meet event to the yielding vehicle and/or the passing vehicle, for the yielding vehicle and/or the passing vehicle to receive the updated meet event from the communication module and change a speed of the yielding vehicle or the passing rail vehicle to arrive at the updated meet event.

25 Claims, 6 Drawing Sheets

(51) Int. Cl.
*B61L 23/32* (2006.01)
*B61L 27/00* (2006.01)

(56) References Cited

U.S. PATENT DOCUMENTS

| | | | | |
|---|---|---|---|---|
| 7,500,436 | B2 | 3/2009 | Kumar et al. | |
| 7,512,481 | B2 | 3/2009 | Julich et al. | |
| 7,618,011 | B2 | 11/2009 | Oleski et al. | |
| 7,669,534 | B2 | 3/2010 | Kumar et al. | |
| 7,680,750 | B2 | 3/2010 | Daum et al. | |
| 7,715,958 | B2 | 5/2010 | Kumar | |
| 7,715,977 | B2 | 5/2010 | Julich et al. | |
| 7,725,249 | B2 | 5/2010 | Kickbusch et al. | |
| 7,734,383 | B2 | 6/2010 | Philp et al. | |
| 7,797,088 | B2 | 9/2010 | Philp et al. | |
| 7,813,846 | B2 | 10/2010 | Wills et al. | |
| 7,882,789 | B2 | 2/2011 | Kumar et al. | |
| 7,937,193 | B2 | 5/2011 | Philp et al. | |
| 7,974,774 | B2 | 7/2011 | Kumar | |
| 8,025,115 | B2 | 9/2011 | King et al. | |
| 2006/0074544 | A1* | 4/2006 | Morariu et al. | 701/117 |
| 2007/0219681 | A1* | 9/2007 | Kumar et al. | 701/19 |
| 2008/0109124 | A1 | 5/2008 | Daum et al. | |
| 2008/0201027 | A1 | 8/2008 | Julich et al. | |
| 2008/0288132 | A1 | 11/2008 | King et al. | |
| 2009/0037039 | A1 | 2/2009 | Kumar et al. | |
| 2009/0099825 | A1 | 4/2009 | Bollapragada | |
| 2009/0118970 | A1 | 5/2009 | Daum et al. | |
| 2009/0132113 | A1 | 5/2009 | Kumar et al. | |
| 2009/0187291 | A1* | 7/2009 | Daum et al. | 701/2 |
| 2009/0254233 | A1 | 10/2009 | Noffsinger et al. | |
| 2010/0019726 | A1 | 1/2010 | Kumar | |
| 2010/0023190 | A1 | 1/2010 | Kumar et al. | |
| 2010/0043388 | A1 | 2/2010 | Mason et al. | |
| 2010/0150705 | A1 | 6/2010 | Mason et al. | |
| 2010/0153419 | A1 | 6/2010 | Daum et al. | |
| 2010/0163687 | A1 | 7/2010 | Brand et al. | |
| 2010/0185472 | A1 | 7/2010 | Goodermuth et al. | |
| 2010/0241295 | A1 | 9/2010 | Cooper et al. | |
| 2011/0051663 | A1 | 3/2011 | Cooper et al. | |
| 2011/0060486 | A1 | 3/2011 | Meltser et al. | |
| 2011/0099413 | A1 | 4/2011 | Cooper et al. | |
| 2011/0106327 | A1 | 5/2011 | Zhou et al. | |
| 2011/0106328 | A1 | 5/2011 | Zhou et al. | |
| 2012/0085871 | A1* | 4/2012 | Chun | 246/2 S |
| 2013/0018531 | A1* | 1/2013 | Kumar | 701/2 |
| 2013/0171590 | A1* | 7/2013 | Kumar | 434/62 |

* cited by examiner

300

| | 302 Scheduled Waypoint (SW) | 304 Scheduled Time (SL) | 306 Actual Time at SW (AT) | 308 Difference/ Adherence |
|---|---|---|---|---|
| 310 | (123.4, 567.8) | 09:00 | 09:00 | 0 |
| 312 | (901.2, 345.6) | 09:30 | 09:33 | (0:03) |
| 314 | (789.0, 234.5) | 10:15 | 10:27 | (0:12) |
| 316 | (678.9, 345.6) | 10:43 | 10:44 | (0:01) |
| 318 | (987.6, 543.2) | 11:02 | 10:58 | +0:04 |
| 320 | (109.8, 765.4) | 11:15 | 11:14 | +0:01 |
| 322 | (321.0, 978.5) | 11:30 | 11:34 | (0:04) |

OFF-BOARD SCHEDULING SYSTEM AND METHOD FOR ADJUSTING A MOVEMENT PLAN OF A TRANSPORTATION NETWORK

CROSS-REFERENCE TO RELATED APPLICATIONS

This application claims priority benefit to U.S. Provisional Application No. 61/483,988, which was filed on May 9, 2011, and is titled "Off-Board Scheduling System And Method For Adjusting A Movement Plan Of A Transportation Network" (the "'988 application"). This application also is related to U.S. Nonprovisional application Ser. No. 13/307,582, which was filed on 30 Nov. 2011, and is titled "Scheduling System And Method For A Transportation Network," and is identified by attorney docket number 252817 (552-0027US2) Network" (the "'582 application"). The entire disclosures of these applications (the '988 application and the '582 application) are incorporated by reference herein.

TECHNICAL FIELD

Embodiments of the inventive subject matter described herein relate to scheduling systems for vehicles traveling in a transportation network.

BACKGROUND

A transportation network for vehicles can include several interconnected main routes on which separate vehicles travel between locations. Some of the main line routes may be single routes, which means that only a single vehicle can travel along the single main line route in a given direction and two vehicles traveling in opposite directions cannot simultaneously travel across the same section of the single main line route. For example, rail vehicles such as trains may travel along a main line track but may be unable to simultaneously travel in opposite directions along the same section of the main line track. However, vehicles may need to travel along the same section of the main line route in an opposite direction. In order to avoid collision between the vehicles traveling in opposite directions on the same section of a single main line route, a siding section of the route may be connected with the main line route.

A siding section of the route may include section of the route that is connected with the main line route and provides an auxiliary path for one of the vehicles traveling in opposite directions on the same single main line route. For example, a first train travelling in a first direction on a main line track can pull off of the main line track onto a siding section of track while a second train travelling in an opposite second direction on the main line track can continue along the main line track and pass the first train on the siding section. This event between two vehicles traveling in opposite directions can be referred to as a "meet event" or a "meet-and-pass event." The first vehicle can be referred to as a "yielding" vehicle and the second vehicle can be referred to as a "passing" vehicle.

The vehicles may move within the transportation network according to various schedules. The schedules may dictate times that the vehicles are expected to arrive at various locations. However, due to various anticipated or unforeseen circumstances, one or more of the vehicles may be running behind schedule. For example, trains may be behind schedule due to damaged portions of the track, unexpected delays in leaving one or more scheduled locations, and the like.

The meet events can be included in the schedules of the vehicles. If one of the vehicles that participates in a meet event is behind schedule and arrives late to the meet event, then the other vehicle in the meet event may need to stop and wait. For example, if the passing train for a meet event is behind schedule, then the yielding train may continue to the originally scheduled meet event and wait an additional time period for the late passing train to arrive and pass on the main line track. Typically, the yielding train travels at the maximum allowable speed on the main line track to the meet event. As a result, the yielding train has unnecessarily traveled to the meet event earlier than required and at a faster speed than required.

A need exists for a system and method for modifying movement plans or schedules of vehicles that reduces meet events that result in yielding vehicles traveling to the meet event too fast and/or too early due to delays in the passing vehicles.

BRIEF DESCRIPTION

In one embodiment, a system (e.g., an off-board scheduling system) includes a monitoring module, a congestion module, a modification module, and a communication module. The monitoring module is configured to monitor plural separate vehicles traveling in a transportation network according to a movement plan of the network. The movement plan directs the vehicles to move through the network according to schedules associated with the separate vehicles and includes an original meet event between a yielding vehicle and a passing vehicle of the separate vehicles. The congestion module is configured to calculate a throughput parameter of the network that is representative of a statistical measure of adherence to the movement plan by the separate vehicles. The modification module is configured to determine a confidence parameter representative of a probability that changing the original meet event does not reduce the throughput parameter of the network. The modification module also is configured to modify the original meet event to an updated meet event when the confidence parameter exceeds a predetermined threshold. The communication module is configured to transmit the updated meet event to one or more of the yielding vehicle or the passing vehicle as at least one of the yielding vehicle or the passing vehicle is moving toward the original meet event, for the one or more of the yielding vehicle or the passing vehicle to receive the updated meet event from the communication module and change a speed of the yielding vehicle or the passing rail vehicle to arrive at the updated meet event.

In another embodiment, a method (e.g., a method for adjusting a movement plan of a transportation network) is provided that includes monitoring plural separate vehicles traveling in the transportation network according to a movement plan of the network. The movement plan directs the vehicles to move through the network according to schedules associated with the separate vehicles. The movement plan includes an original meet event between a yielding vehicle and a passing vehicle of the separate vehicles. The method also includes determining a throughput parameter of the network that is representative of a statistical measure of adherence to the movement plan by the separate vehicles, determining a confidence parameter representative of a probability that changing at least one of an original location or an original time of the original meet event does not reduce the throughput parameter of the network, modifying at least one of the original location or the original time of the original meet event to at least one of an updated location or an updated time of an updated meet event when the confidence parameter exceeds a predetermined threshold, and transmitting at least one of the updated location or the updated time to one or more of the yielding vehicle or the passing vehicle as at least one of the yielding vehicle or the passing vehicle is moving toward the location of the original meet event.

In another embodiment, a computer readable storage medium for a system having a processor (e.g., an off-board scheduling system of a transportation network) is provided. The computer readable storage medium includes one or more sets of instructions configured to direct the processor to monitor plural separate vehicles traveling in the transportation network according to a movement plan of the network. The movement plan directs the vehicles to move through the network according to schedules associated with the separate vehicles. The movement plan includes an original meet event between a yielding vehicle and a passing vehicle of the separate vehicles. The one or more sets of instructions also are configured to direct the processor to determine a throughput parameter of the network that is representative of a statistical measure of adherence to the movement plan by the separate vehicles and determine a confidence parameter representative of a probability that changing at least one of an original location or an original time of the original meet event does not reduce the throughput parameter of the network. The one or more sets of instructions are further configured to direct the processor to modify at least one of the original location or the original time of the original meet event to at least one of an updated location or an updated time of an updated meet event when the confidence parameter exceeds a predetermined threshold and to transmit at least one of the updated location or the updated time to one or more of the yielding vehicle or the passing vehicle as at least one of the yielding vehicle or the passing vehicle is moving toward the location of the original meet event, for the one or more of the yielding vehicle or the passing vehicle to receive the at least one of the updated location or the updated time and change a speed of the yielding vehicle or the passing rail vehicle to arrive at the updated meet event.

In another embodiment, a method (e.g., a method for directing movement of vehicles in a transportation network) includes, at one of a yielding vehicle or a passing vehicle, receiving from an off-board scheduling system at least one of an updated location or an updated time of a meet event of the yielding vehicle and the passing vehicle and changing a speed of said one of the yielding vehicle or the passing vehicle in response to said at least one of the updated location or the updated time to arrive at the meet event.

In another embodiment, a system (e.g., an on-board control system of a vehicle) includes a control unit that is configured to be disposed on-board a first vehicle and to receive from an off-board scheduling system at least one of an updated location or an updated time of a meet event of the first vehicle and a second vehicle. The control unit is configured to change a speed of said first vehicle in response to said at least one of the updated location or the updated time to arrive at the meet event.

In another embodiment, a system (e.g., an on-board system of a vehicle) includes a control unit for a first vehicle and a computer readable storage medium. The computer readable storage medium has one or more sets of instructions that are configured to direct the control unit to receive at least one of an updated location or an updated time of a meet event of the first vehicle and a second vehicle from an off-board scheduling system and change a speed of the first vehicle in response to said at least one of the updated location or the updated time to arrive at the meet event.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide a scheduling system that monitors several vehicles travelling in a transportation network of a plurality of routes. The vehicles travel in the transportation network according to one or movement plans. The movement plans provide schedules for the vehicles to move through the transportation network. The movement plan includes meet events between two or more vehicles. A meet event can be a location and time at which first and second vehicles simultaneously travel toward each other in opposite directions along a common section of a route, and the first vehicle is scheduled to pass the second vehicle when the second vehicle pulls off of the common section of the route onto a siding section of the route. For example, a meet event can include a location of the transportation network that includes a main line of a rail track having a siding section of the track. During the meet event, the second vehicle moves off of the main line of the track to the siding section of the track and may stop or slow while the first vehicle continues to move along the main line and pass the second vehicle. The first vehicle that passes the second vehicle at the meet event may be referred to as the passing vehicle. The second vehicle that moves to the siding section to allow the passing vehicle to pass can be referred to as the yielding or give way vehicle.

The scheduling system can monitor a throughput parameter of the transportation network. The throughput parameter represents a statistical or quantitative measure of adherence to the movement plan by the vehicles. A relatively high throughput parameter indicates that the vehicles are traveling through the network according to the respective schedules. A relatively low throughput parameter may indicate that one or more of the vehicles are traveling through the network ahead of (e.g., arriving early at scheduled locations) or behind (e.g., arriving late at scheduled locations) the respective schedules. The scheduling system can determine a confidence parameter that represents a probability that changing a speed of one or more vehicles arriving at a meet event will not negatively impact the throughput parameter. For example, if a passing vehicle is set to arrive late to a meet event (or the yielding vehicle is set to arrive early to the meet event), the scheduling system may determine a low probability that slowing the speed of the yielding vehicle will negatively impact (e.g., reduce) the throughput parameter.

The scheduling system can modify the meet event and transmit the modified meet event to one or more of the vehicles. The vehicles may proceed toward the meet event based on the modified details. For example, the yielding vehicle may slow down to arrive at the meet event later than originally scheduled. The slowing of the yielding vehicle can increase fuel savings while avoiding increasing the congestion of the transportation network.

Figure 1:
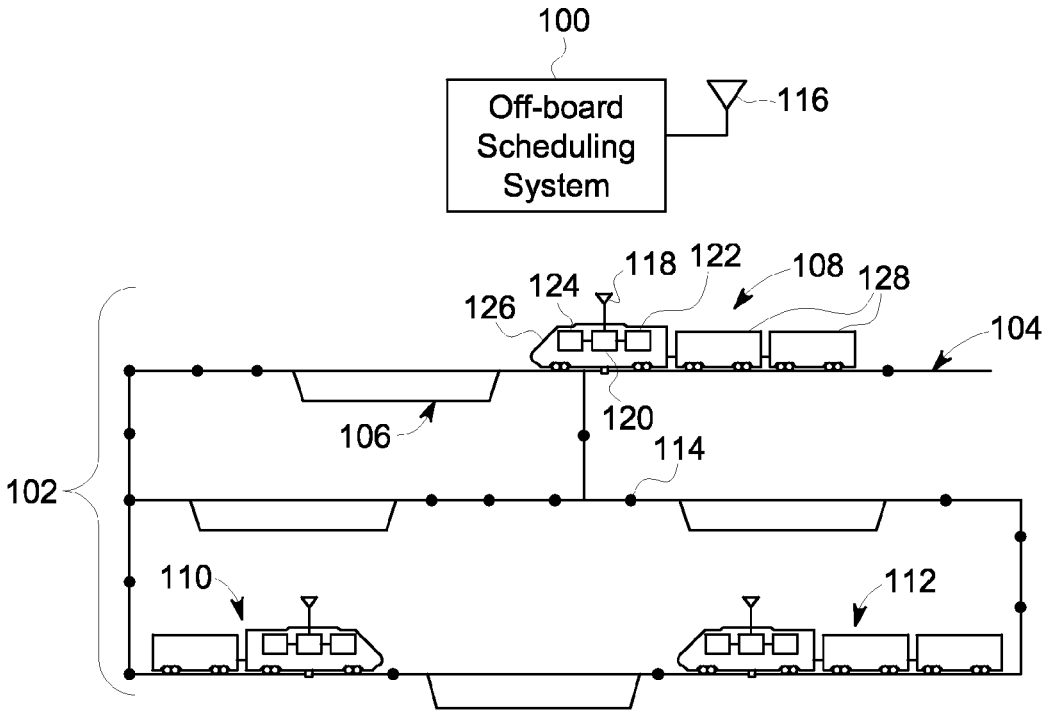
FIG. 1 is a schematic view of one embodiment of an off-board scheduling system and a transportation network.

FIG. 1 is a schematic view of one embodiment of a scheduling system 100 and a transportation network 102. The transportation network 102 includes a plurality of interconnected routes 104, 106. In the illustrated embodiment, the routes 104, 106 represent tracks, such as railroad tracks, that rail vehicles travel across. The routes 104 include main line routes 104 and siding section routes 106. The transportation network 102 may extend over a relatively large area, such as hundreds of square miles or kilometers of land area. The number of routes 104, 106 shown in FIG. 1 is meant to be illustrative and not limiting on embodiments of the described subject matter. Moreover, while one or more embodiments described herein relate to a transportation network formed from rail tracks, not all embodiments are so limited. One or more embodiments may relate to transportation networks having main line routes that cannot be simultaneously traversed in opposite directions by different non-rail vehicles and siding section routes that are connected with the main line routes.

Plural separate vehicles 108, 110, 112 travel along the routes 104, 106. In the illustrated embodiment, the vehicles 108, 110, 112 are shown and described herein as rail vehicles or rail vehicle consists. However, one or more other embodiments may relate to vehicles other than rail vehicles or rail vehicle consists. For example, the vehicles may represent other off-highway vehicles, automobiles (e.g., cars, busses, and the like), marine vessels, airplanes, and the like. A vehicle 108, 110, 112 may include a group of powered vehicles 126 (referring to rail vehicles configured for self propulsion, e.g., locomotives) and/or non-powered vehicles 128 (referring to rail vehicles not configured for self propulsion, e.g., cargo or passenger cars) that are mechanically coupled or linked together to travel along the routes 104, 106. As shown in FIG. 1, the main line routes 104 are interconnected with each other to permit the vehicles 108, 110, 112 to travel over various combinations of the routes 104 to move from a starting location to a destination location. The main line routes 104 may be single track railway lines. For example, each of the main line routes 104 may be shared by vehicles 108, 110, 112 moving in opposite directions. In order to avoid collisions between vehicles 108, 110, 112 traveling in opposite directions toward each other on a common main line route 104 (such as the vehicles 110, 112 in FIG. 1), the siding section route 106 may be connected with the main line route 104.

The siding section route 106 is an auxiliary portion of a route that branches off of the main line route 104. The siding section route 106 may be connected to the main line route 104 and may run parallel to the main line route 104 between two or more locations where the siding section route 106 is coupled with the main line route 104. In one embodiment, the siding section route 106 may be formed from lighter materials or construction such that the siding section route 106 may have lower speed and/or weight limits than the main line route 104. The siding section route 106 may be used by the vehicles 108, 110, 112 to move off of the main line route 104 when another vehicle 108, 110, 112 is approaching. For example, the vehicle 110 may move from the main route 104 to the siding section route 106 when a second rail vehicle 112 approaches along the same main route 104. The vehicle 110 can travel, slow down, and/or stop on the siding section route 106 until the second rail vehicle 112 has passed on the main route 104. Once the second rail vehicle 112 has passed, the first rail vehicle 110 can return to the main route 104.

In one embodiment, the vehicle 108, 110, 112 that moves to the siding section route 106 is referred to as a "yielding vehicle" or a "stopping vehicle," even though the vehicle 108, 110, 112 may not cease all movement on the siding section route 106. The vehicle 108, 110, 112 that passes on the main route 104 while the yielding vehicle 108, 110, 112 is on the siding section route 106 can be referred to as a "passing vehicle." A "meet event" represents a location and/or time at which the passing vehicle 108, 110, 112 and the yielding vehicle 108, 110, 112 meet and pass each other. For example, a meet event can include the geographic location of the siding section route 106 and the time at which the passing vehicle 108, 110, 112 passes the geographic location of the siding section route 106.

The vehicles 108, 110, 112 travel along the routes 104, 106 according to a movement plan of the transportation network 102. The movement plan is a logical construct of the movement of the vehicles 108, 110, 112 moving through the transportation network 102. For example, the movement plane may include a schedule for each of the vehicles 108, 110, 112, with the schedules directing the vehicles 108, 110, 112 to move along the routes 104, 106 at associated times. In one embodiment, the movement plan includes a list, table, or other logical arrangement of geographic locations (e.g., Global Positioning System coordinates) within the transportation network 102 and associated times. The vehicles 108, 110, 112 move along various paths within the transportation network 102 to arrive at the geographic locations associated with the schedule of each vehicle 108, 110, 112 at the specified times. The locations in the movement plan can be referred to as "scheduled waypoints" and the times at which the vehicles 108, 110, 112 are scheduled to arrive or pass the scheduled waypoints can be referred to as "scheduled times."

The movement plan can be based on starting locations and destination locations of the vehicles 108, 110, 112. For example, a schedule may be developed for each vehicle 108, 110, 112 that directs the vehicle 108, 110, 112 where and when to move within the transportation network 102 to arrive at a specified destination from the starting location of the vehicle 108, 110, 112. The schedules may include several scheduled waypoints located between the starting location and the destination location of the vehicle 108, 110, 112, along with scheduled times for the scheduled waypoints. For example, a schedule may include several waypoints 114 located along a route between the starting location and the destination location of a vehicle 108, 110, 112.

The movement plan may be determined by the scheduling system 100. As shown in FIG. 1, the scheduling system 100 can be disposed off-board (e.g., outside) of the vehicles 108, 110, 112. For example, the scheduling system 100 may be disposed at a central dispatch office for a railroad company. The scheduling system 100 communicates the schedules of the vehicles 108, 110, 112. The scheduling system 100 can include a wireless antenna 116 (and associated transceiving equipment), such as a radio frequency (RF) or cellular antenna, that wirelessly transmits the schedules to the vehicles 108, 110, 112. For example, the scheduling system 100 may transmit a different list of waypoints 114 and associated scheduled times to each of the vehicles 108, 110, 112.

The vehicles 108, 110, 112 include wireless antennas 118, such as RF or cellular antennas, that receive the schedules from the scheduling system 100. The wireless antenna 118 communicates the received schedule to an energy management system 120 disposed on-board the vehicle 108, 110, 112. The energy management system 120 may be embodied in a computer, computer processor, microcontroller, microprocessor, or other logic-based device, that operates based on one or more sets of instructions (e.g., software) stored on a tangible and non-transitory computer readable storage medium (e.g., hard drive, flash drive, ROM, or RAM). The energy management system 120 may include a location determining device, such as a Global Positioning System (GPS) device, that identifies a current location of the vehicle 108, 110, 112 and a timing device, such as a clock, that determines a current time of the vehicle 108, 110, 112. The energy management system 120 can compare the current location and time of the vehicle 108, 110, 112 to the received schedule to determine if the vehicle 108, 110, 112 is ahead of schedule (e.g., is arriving at a scheduled waypoint 114 before an associated scheduled time), behind schedule (e.g., is arriving at a scheduled waypoint 114 after an associated scheduled time), or on time (e.g., is arriving at a scheduled waypoint 114 at a scheduled time or within a predetermined time period of the associated scheduled time).

Based on the comparison between the current location and time of the vehicle 108, 110, 112 and the received schedule, the energy management system 120 may generate control instructions that direct operation of a propulsion subsystem 122 of the respective vehicle 108, 110, 112. The propulsion subsystem 122 can include one or more traction motors, brakes, and the like, that provide tractive effort to propel the vehicle 108, 110, 112 along the routes 104, 106 and provide braking efforts to slow or stop movement of the vehicle 108, 110, 112. The control instructions may include commands that direct an operator of the vehicle 108, 110, 112 to change or set the tractive effort and/or braking effort supplied by the propulsion subsystem 122 of the vehicle 108, 110, 112, or commands that automatically change or set the tractive effort and/or braking effort. For example, if the vehicle 108, 110, 112 is behind schedule, the control instructions may reduce braking effort and/or increase tractive effort. If the vehicle 108, 110, 112 is ahead of schedule, the control instructions may increase braking effort and/or reduce tractive effort.

In the illustrated embodiment, the energy management system 120 determines a trip plan that dictates one or more operations of the propulsion subsystem 122 during a trip of the corresponding vehicle 108, 110, 112. A trip of the vehicle 108, 110, 112 includes the travel of the vehicle 108, 110, 112 from a starting location to a destination location. The energy management system 120 can refer to a trip profile that includes information related to the vehicle 108, 110, 112, the route or surface on which the vehicle 108, 110, 112 travels, the geography over which the route or surface extends, and other information in order to form the trip plan. The trip plan can be used to control the propulsion subsystems of different powered rail vehicles in the vehicle 108, 110, or 112 to change the tractive efforts of the propulsion subsystems as the vehicle 108, 110, 112 travels over different segments of the trip according to the trip plan.

For example, if the trip profile requires the vehicle 108, 110, or 112 to traverse a steep incline and the trip profile indicates that the vehicle 108, 110, or 112 is carrying significantly heavy cargo, then the energy management system 120 may form a trip plan that directs one or more of the powered rail vehicles of the vehicle 108, 110, or 112 to increase the tractive efforts supplied by the respective propulsion subsystems. Conversely, if the vehicle 108, 110, or 112 is carrying a smaller cargo load based on the trip profile, then the energy management system 120 may form a trip plan that directs the propulsion subsystems to increase the supplied tractive efforts by a smaller amount than the tractive efforts would otherwise be increased if the data indicated a heavier cargo load. The trip plan may be formed according to other factors, such as changes in the route that the vehicle 108, 110, or 112 travels along, regulatory requirements (e.g., emission limits) of the regions through which the vehicle 108, 110, or 112 travels, and the like, and based on the trip profile. In one embodiment, the energy management system 120 includes a software application such as the Trip Optimizer™ system provided by General Electric Company, to control propulsion operations of the vehicle 108, 110, or 112 during the trip in order to reduce fuel consumption of the powered rail vehicles and/or to reduce wear and tear on the vehicle 108, 110, 112.

The trip data used to form the trip profile may include vehicle (e.g., train) data, route data, and/or an update to trip data, vehicle data, or route data. Vehicle (e.g., train) data includes information about the vehicle and/or cargo being carried by the vehicle. For example, vehicle data may represent cargo content (such as information representative of cargo being transported by the vehicle) and/or vehicle information (such as model numbers, manufacturers, horsepower, and the like, of locomotives and/or other railcars in the vehicle). Route data may include information about an upcoming trip by the vehicle. By way of example, route data may include a trip profile of an upcoming trip of the vehicle (e.g., information that can be used to control one or more operations of the vehicle, such as tractive and/or braking efforts provided during the powered units of a vehicle during an upcoming trip), station information (such as the location of a beginning station where the upcoming trip is to begin and/or the location of an ending station where the upcoming trip is to end), restriction information (such as work zone identifications, or information on locations where the route is being repaired or is near another route being repaired and corresponding speed/throttle limitations on the vehicle), and/or operating mode information (such as speed/throttle limitations on the vehicle in various locations, slow orders, and the like). Route data can include information about the route or rails upon which the vehicle travels. For example, the route data can include information about locations of damaged sections of a route, locations of route sections that are under repair or construction, the curvature and/or grade of a route, GPS coordinates of the route, and the like. The route data is related to operations of the vehicle as the route data includes information about the route that the vehicle is or will be traveling on. However, other types of data can be recorded as the data and/or the data may be used for other operations. The term "data" may refer to trip data, vehicle (e.g., train) data, and route data, only one of trip data, vehicle data, or route data, or another type of data.

In one embodiment, the vehicle 108, 110, 112 includes a display device 124 that visually presents the control instructions to the operator on-board the vehicle 108, 110, 112. For example, a computer monitor or display screen may present textual settings for a throttle or brake setting of the propulsion subsystem 122. The textual settings prompt the operator to change the tractive effort and/or braking effort of the propulsion subsystem 122. Alternatively, the control instructions may be communicated to the propulsion subsystem 122 to automatically control the tractive effort and/or braking effort of the propulsion subsystem 122. For example, the propulsion subsystem 122 may receive an updated throttle or brake setting from the energy management system 120 and modify the tractive effort or braking effort in response thereto.

Figure 2:
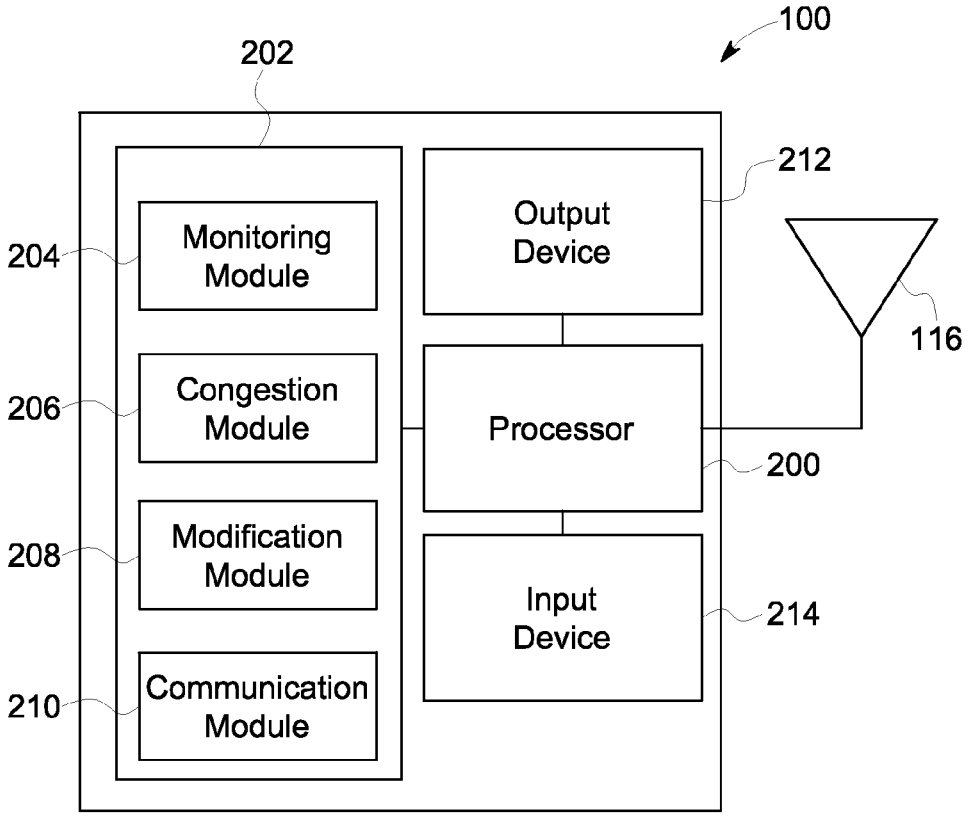
FIG. 2 is a schematic diagram of one embodiment of the off-board scheduling system shown in FIG. 1.

FIG. 2 is a schematic diagram of one embodiment of the off-board scheduling system 100. The scheduling system 100 includes a processor 200 (e.g., a computer processor, microprocessor, controller, microcontroller, or other logic-based computer device) that is communicatively coupled with a tangible and non-transitory computer readable storage medium 202, such as a computer hard drive, flash drive, RAM, ROM, EEPROM, and the like. The storage medium 202 includes one or more sets of instructions that direct the processor 200 to perform various operations or steps. For example, the storage medium 202 can include software applications. In the illustrated embodiment, the sets of instructions are shown as a monitoring module 204, a congestion module 206, a modification module 208, and a communication module 210. Alternatively, one or more of the monitoring module 204, the congestion module 206, the modification module 208, and/or the communication module 210 may be embodied in a processor similar to the processor 200. For example, one or more of the modules 204, 206, 208, 210 may each be a dedicated processor or application specific integrated circuit (ASIC).

An output device 212 is communicatively coupled with the processor 200. The output device 212 presents information to an operator of the scheduling system 100, such as schedules of vehicles 108, 110, 112 (shown in FIG. 1), adherence of the vehicles 108, 110, 112 to the schedules, throughput parameters (described below) of the transportation network 102 (shown in FIG. 1), and the like. By way of example, the output device 212 may include a computer monitor, touchscreen, a printer, a speaker, and the like. An input device 214 is communicatively coupled with the processor 200. The input device 214 receives information from the operator and communicates the information to the processor 200. The operator may control operation of the scheduling system 100 using the input device 214. By way of example, the input device 214 may include a keyboard, electronic mouse device, stylus, touchscreen, microphone, and the like.

The monitoring module 204 monitors the vehicles 108, 110, 112 (shown in FIG. 1) as the vehicles 108, 110, 112 travel through the transportation network 102 (shown in FIG. 1). The monitoring module 204 can track locations of the vehicles 108, 110, 112. For example, each of the vehicles 108, 110, 112 may periodically transmit the actual locations and/or times at which the actual locations are determined to the antenna 116 of the scheduling system 100. The actual locations and times of the vehicles 108, 110, 112 can be conveyed to the monitoring module 204 so that the monitoring module 204 can determine where the various vehicles 108, 110, 112 are located within the transportation network 102.

The congestion module 206 determines one or more throughput parameters of the transportation network 102 (shown in FIG. 1) based on the schedules of the vehicles 108, 110, 112 (shown in FIG. 1), the actual locations of the vehicles 108, 110, 112, and the times at which the actual locations are determined. The throughput parameter can represent the flow or movement of the vehicles 108, 110, 112 through the transportation network 102. In one embodiment, the throughput parameter can indicate how successful the vehicles 108, 110, 112 are in traveling according to the schedules associated with each of the vehicles 108, 110, 112. For example, the throughput parameter can be a statistical measure of adherence by one or more of the vehicles 108, 110, 112 to the various schedules of the vehicles 108, 110, 112 in the movement plan.

The term "statistical measure of adherence" refers to a quantity that is calculated for a vehicle 108, 110, 112 and that indicates how closely the vehicle 108, 110, 112 is following the schedule associated with the vehicle 108, 110, 112. Several statistical measures of adherence to the movement plan may be calculated for the vehicles 108, 110, 112 traveling in the transportation network 102. The throughput parameter may be based on or calculated from the statistical measures of adherence of the several vehicles 108, 110, 112.

In order to determine a statistical measure of adherence to the schedule associated with vehicles 108, 110, 112, the congestion module 206 determines if the vehicle 108, 110, 112 adheres to the schedule. A vehicle 108, 110, 112 adheres to the schedule of the vehicle 108, 110, 112 by arriving at or passing through the scheduled waypoints 114 (shown in FIG. 1) of the schedule at the scheduled times, or within a predetermined time buffer of the scheduled times. A vehicle 108, 110, 112 does not adhere to the schedule when the vehicle 108, 110, 112 does not arrive at or pass through one or more of the scheduled waypoints 114, or arrives at or passes through the scheduled waypoints 114 ahead of schedule or behind schedule. The statistical measure of adherence may be based on the number of scheduled waypoints 114 that the vehicle 108, 110, 112 arrives at or passes through the scheduled waypoints 114 at the associated scheduled time and/or within a predetermined time buffer of the scheduled time.

Alternatively or in addition to the above, the statistical measure of adherence may be based on one or more time differences between (a) the scheduled time that the vehicle 108, 110, 112 is to arrive at or pass through a scheduled waypoint 114 and (b) the actual time that the vehicle 108, 110, 112 arrives at or passes through the scheduled waypoint 114. For example, the statistical measure of adherence may be a sum of the time differences between the actual times of arrival and the scheduled times for several scheduled waypoints 114 of a vehicle 108, 110, 112. In another embodiment, another quantifiable measure may be performed to determine how closely the vehicle 108, 110, 112 is following or abiding by the schedule of the vehicle 108, 110, 112.

Figures 3, 4:
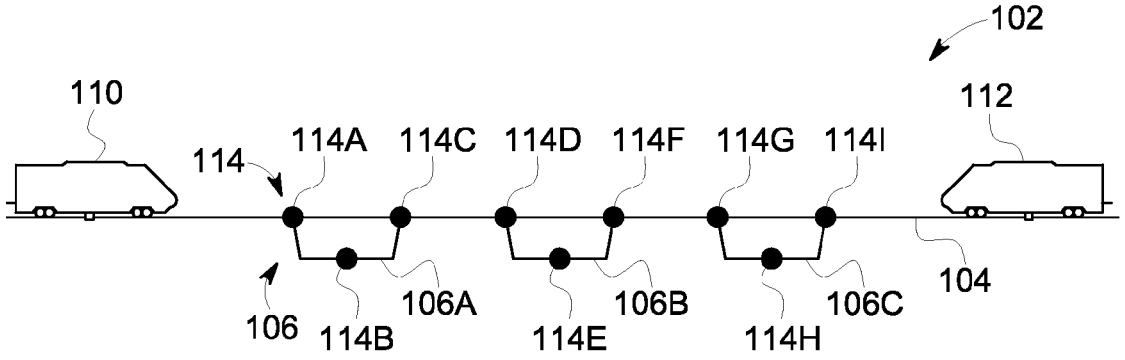
FIG. 3 is a table of one or more examples of statistical measures of adherence of a vehicle shown in FIG. 1 to an associated schedule of the movement plan.
FIG. 4 is a schematic diagram of a section of one embodiment of the transportation network shown in FIG. 1.

FIG. 3 is a table 300 of one or more examples of statistical measures of adherence of a vehicle 108, 110, or 112 (shown in FIG. 1) to an associated schedule of the movement plan. The table 300 includes four columns 302, 304, 306, 308 and seven rows 310, 312, 314, 316, 318, 320, 322. The table 300 represents at least a portion of a schedule of the vehicle 108, 110, 112. Several tables 300 may provide different schedules for different vehicles 108, 110, 112 in the movement plan for the transportation network 102 (shown in FIG. 1).

The first column 302 includes a list of locations of scheduled waypoints 114 (shown in FIG. 1). The second column 304 includes a list of scheduled times that are associated with the scheduled waypoints 114. For example, each row 310, 312, 314, 316, 318, 320, 322 includes a scheduled waypoint 114 and the associated scheduled time. The third column 306 includes a list of the actual times that the vehicle 108, 110, or 112 (shown in FIG. 1) arrives a or passes through the associated scheduled waypoint 114. For example, each row 310, 312, 314, 316, 318, 320, 322 includes the actual time that the vehicle 108, 110, or 112 arrives at or passes through the scheduled waypoint 114 listed in the first column 302 for the row 310, 312, 314, 316, 318, 320, or 322. The fourth column 308 includes a list of differences between the scheduled times in the second column 304 and the actual times in the third column 306 for each row 310, 312, 314, 316, 318, 320, 322.

The fourth column 308 may be used to calculate the statistical measure of adherence to a schedule for the vehicle 108, 110, or 112 (shown in FIG. 1). In one embodiment, the statistical measure of adherence for the vehicle 108, 110, or 112 may represent the number or percentage of scheduled waypoints 114 (shown in FIG. 1) that the vehicle 108, 110, or 112 arrived too early or too late. For example, the congestion module 206 (shown in FIG. 2) counts the number of scheduled waypoints 114 that the vehicle 108, 110, or 112 arrives at or passes through outside of a time buffer around the scheduled time. The time buffer can be one to several minutes. By way of example only, if the time buffer is three minutes, then the congestion module 206 may examine the differences between the scheduled times (in the second column 304) and the actual times (in the third column 306) and count the number of scheduled waypoints 114 that the vehicle 108, 110, or 112 arrived more than three minutes early or more than three minutes late.

Alternatively, the congestion module 206 may count the number of scheduled waypoints 114 (shown in FIG. 1) that the vehicle 108, 110, or 112 (shown in FIG. 1) arrived early or late without regard to a time buffer. In the illustrated embodiment, the vehicle 108, 110, or 112 arrived at four of the scheduled waypoints 114 within the time buffer of the scheduled times (e.g., the scheduled waypoints 114 represented by the rows 310, 312, 316, and 320), arrived too late at two of the scheduled waypoints 114 (e.g., the scheduled waypoints 114 represented by the rows 314 and 322), and arrived too early at one of the scheduled waypoints 114 (e.g., the scheduled waypoint 114 represented by the row 320).

Returning to the discussion of the scheduling system 100 shown in FIG. 2, and with continued reference to the table 300 shown in FIG. 3, the congestion module 206 may calculate the statistical measure of adherence by the vehicle 108, 110, or 112 (shown in FIG. 1) to the schedule based on the number or percentage of scheduled waypoints 114 (shown in FIG. 1) that the vehicle 108, 110, or 112 arrived on time (or within the time buffer). In the illustrated embodiment, the congestion module 206 can calculate that the vehicle 108, 110, or 112 adhered to the schedule (e.g., remained on schedule) for 57% of the scheduled waypoints 114 and that the vehicle 108, 110, or 112 did not adhere (e.g., fell behind or ahead of the schedule) for 43% of the scheduled waypoints 114.

Alternatively, the congestion module 206 may calculate the statistical measure of adherence by the vehicle 108, 110, or 112 (shown in FIG. 1) to the schedule based on the total or sum of time differences between the scheduled times associated with the scheduled waypoints 114 (shown in FIG. 1) and the actual times that the vehicle 108, 110, or 112 arrived or passed the scheduled waypoints 114. With respect to the example shown in the table 300 of FIG. 3, the congestion module 206 may sum the time differences shown in the fourth column 308 as the statistical measure of adherence. In the example of the table 300, the statistical measure of adherence is −15 minutes, or a total of 15 minutes behind the schedule of the vehicle 108, 110, or 112.

In another embodiment, the congestion module 206 may calculate the average statistical measure of adherence by comparing the deviation of each vehicle 108, 110, 112 (shown in FIG. 1) from the average or median statistical measure of adherence of the several vehicles 108, 110, 112 traveling in the transportation network 102. For example, the congestion module 206 may calculate an average or median deviation of the vehicles 108, 110, 112 from the average or median statistical measure of adherence of the vehicles 108, 110, 112.

The congestion module 206 determines the throughput parameter of the transportation network 102 (shown in FIG. 1) based on the statistical measures of adherence for a plurality of the rail vehicles 108, 110, 112 (shown in FIG. 1). For example, the congestion module 206 may calculate the throughput parameter based on the statistical measure of adherence for all, substantially all, a supermajority, or a majority of the vehicles 108, 110, 112 traveling in the transportation network 102. In one embodiment, the congestion module 206 calculates an average or median of the statistical measures of adherence for the vehicles 108, 110, 112 traveling in the transportation network 102. However, the throughput parameter may be calculated in other ways. The throughput parameter can indicate an average or median rate of throughput or rate of travel through the transportation network 102, such as an average or median rate at which the vehicles 108, 110, 112 travel according to the associated schedules.

As described above, the movement plan of the transportation network 102 (shown in FIG. 1) may include one or more meet events at a location of a main route 104 (shown in FIG. 1) that includes a siding section route 106 (shown in FIG. 1). The meet event can be included in the schedules of one or more of the vehicles 108, 110, 112 (shown in FIG. 1). For example, an original meet event may be in the schedule of a yielding vehicle 110 in a manner that directs the yielding vehicle 110 to move to the siding section route 106 at a scheduled waypoint 114 (shown in FIG. 1) at a scheduled time and remain on the siding section route 106 (e.g., slow down and/or stop) until the passing vehicle 112 passes the siding section route 106 on the main line route 104. The schedule may then direct the yielding vehicle 110 to travel back onto the main line route 104 and proceed to another scheduled waypoint 114. With respect to the passing vehicle 112, the schedule may direct the passing vehicle 112 to proceed to and pass the siding section route 106 at a scheduled time as a scheduled waypoint 114. As used herein, the term "original" means a current or previous state of a scheduled event. For example, an original time of an event may be the first scheduled time for an event, or a previously scheduled time for an event, that may be changed as described herein. An "original" time, location, or event may not necessarily be the first scheduled time or the first scheduled location for an event. For example, an event may have a first scheduled time that is modified into a second scheduled time. The second scheduled time may later be modified into a third scheduled time. With respect to the second scheduled time, the first scheduled time may be an original time. With respect to the third scheduled time, the second scheduled time may be an original time.

As the vehicles 108, 110, 112 (shown in FIG. 1) travel in the transportation network 102 (shown in FIG. 1), one or more vehicles 108, 110, 112 may deviate from the movement plan by moving ahead or behind in the associated schedules. The original meet event between the yielding vehicle 110 and the passing vehicle 112 in the movement plan may be modified by the scheduling system 100 due to one or more of the yielding vehicle 110 and/or the passing vehicle 112 deviating from the associated schedules. For example, the originally scheduled time and/or location of the meet event can be modified to an updated time and/or location. In one embodiment, if the passing vehicle 112 is behind schedule and will arrive at the location or waypoint 114 (shown in FIG. 1) of the original meet event later than scheduled, then the yielding vehicle 110 may be able to slow down and also arrive at the location or waypoint 114 of the original meet event later than originally scheduled.

In another example, if the yielding vehicle 110 is behind schedule and the passing vehicle 112 is on schedule or ahead of schedule, the scheduling system 100 may direct the passing vehicle 112 to slow down to allow for the yielding vehicle 110 to have sufficient time to reach and move onto the siding section route 106 before the passing vehicle 112 reaches the same siding section route 106. For example, the yielding vehicle 110 may be behind schedule and may not be able to completely enter the siding section route 106 of a meet event before the passing vehicle 112 arrives at the meet event. The yielding vehicle 110 may be unable to completely enter the siding section route 106 when one or more cars or units of the yielding vehicle 110, or a portion thereof, is still on the main line route 104 or is still transitioning from the main line route 104 to the siding section route 106 at the originally scheduled time of the meet event, or within a predetermined time buffer of the originally scheduled time. In such a situation, the scheduling system 100 may direct the passing vehicle 112 to slow down such that the yielding vehicle 110 is completely disposed on the siding section route 106 (e.g., no cars, units, or portions of the yielding vehicle 110 are on the main line route 104) when the passing vehicle 112 arrives at the meet event, or when the passing vehicle 112 reaches a waypoint disposed ahead of the meet event. Such slowing down by the vehicle 110 or 112 can result in fuel savings since the vehicle 110 or 112 may consume less fuel when moving slower.

The originally scheduled location or waypoint 114 (shown in FIG. 1) may be modified by the scheduling system 100 to an updated location or waypoint 114. For example, the yielding vehicle 110 (shown in FIG. 1) may move to a different siding section route 106 (shown in FIG. 1) located farther downstream along the main line route 104 for the meet event. In another embodiment, the scheduling system 100 may change which of the vehicles 110, 112 is the yielding vehicle and which is the passing vehicle. For example, if the original yielding vehicle 110 is behind schedule by a sufficient amount and the original passing vehicle 112 is on schedule or ahead of schedule by a sufficient amount, then the scheduling system 100 may direct the original passing vehicle 112 to be the updated yielding vehicle 110 and move to the siding section route 106 while the original yielding vehicle 110 becomes the passing vehicle 112 and passes the updated yielding vehicle 110 on the main line route 104. In another embodiment, the scheduling system 100 may direct the passing vehicle 112 to slow down as the passing vehicle 112 approaches the meet event so that the yielding vehicle 110 that is traveling behind schedule can enter onto the siding section route 106 before the passing vehicle 112 passes the siding section route 106.

In order to modify the original meet event to an updated meet event, the modification module 208 of the scheduling system 100 determines a confidence parameter that changing the original meet event does not negatively impact the throughput parameter of the transportation network 102 (shown in FIG. 1). For example, the modification module 208 determines the probability that changing a location of the meet event, changing a scheduled time of the meet event for the yielding vehicle 110 and/or the passing vehicle 112, and/or changing which vehicle 108, 110, 112 (shown in FIG. 1) is the yielding vehicle at the meet event will not decrease the throughput parameter of the transportation network 102. This probability may represent the confidence parameter. As described above, a decreasing throughput parameter can indicate that more rail vehicles 108, 110, 112 are deviating from the associated schedules and movement plan, such as by being behind schedule. In some instances, a decreasing throughput parameter can represent increased traffic congestion in the transportation network 102. As congestion increases within the transportation network 102, one or more vehicles 108, 110, 112 may be delayed from associated destination locations.

If the confidence parameter determined by the modification module 208 is sufficiently high, the modification module 208 can adjust the original meet event to an updated meet event, as described below. The relatively high confidence parameter can indicate that modifying the original meet event will not negatively impact the throughput parameter of the transportation network 102 (shown in FIG. 1), such as by increasing traffic congestion in the transportation network 102. Conversely, if the confidence parameter is too low, then the confidence parameter can indicate that modifying the original meet event may negatively impact the throughput parameter, such as by decreasing the throughput parameter and increasing congestion (e.g., causing more vehicles 108, 110, 112 shown in FIG. 1 to fall behind schedule) in the transportation network 102.

FIG. 4 is a schematic diagram of a section of one embodiment of the transportation network 102 shown in FIG. 1. The illustrated section includes a portion of the main line route 104 and a plurality of the siding section routes 106. The siding section routes 106 are generally referred to by the reference number 106 and are individually referred to by the reference numbers 106A, 106B, or 106C. Several waypoints 114 are shown on the routes 104, 106. The waypoints 114 generally referred to by the reference number 114 and individually referred to by the reference numbers 114A, 114B, 114C, and so on. The vehicles 110, 112 are traveling in opposite directions towards each other on the main line route 104. The vehicles 110, 112 are shown in FIG. 4 without the non-powered units 128 (shown in FIG. 1). The vehicles 110, 112, routes 104, 106, and the distances between and among the waypoints 114 are not drawn to scale in FIG. 4.

The vehicles 110, 112 are moving toward a meet event that involves both of the vehicles 110, 112. For example, the vehicle 110 may be the yielding vehicle and the vehicle 112 may be the passing vehicle in the meet event. The movement plan can include an original meet event that is scheduled to occur at the second, or middle, siding section route 106B. The location of the meet event can be the waypoint 114D for the yielding vehicle 110 as this may be the location at which the yielding vehicle 110 moves from the main line route 104 to the siding section route 106B to avoid collision with the passing vehicle 112. On the other hand, the location of the meet event for the passing vehicle 112 may be the waypoint 114F, or a location where the second siding section route 106B meets up with the main line route 104. The first and third siding section routes 106A, 106C represent alternate or potential meet events.

The modification module 208 (shown in FIG. 2) of the scheduling system 100 (shown in FIG. 1) determines a confidence parameter that changing the scheduled time and/or location of the meet event will not reduce the throughput parameter. For example, the modification module 208 may calculate a probability that delaying the time that the yielding and/or passing vehicle 110, 112 is scheduled to arrive at the meet event will not reduce the throughput parameter of the transportation network 102. In another example, the modification module 208 may calculate one or more probabilities that changing the location of the meet event from the second siding section route 106B to the first siding section route 106A or the third siding section route 106C will not reduce the throughput parameter of the transportation network 102.

In one embodiment, the confidence parameter is based on a closing distance between one or more of the vehicles 110, 112 and a location of the original meet event. The "closing distance" means a distance between a current location of a vehicle 110, 112 and a scheduled location (e.g., a location of a meet event). For example, the confidence parameter may be based on the closing distance between the yielding vehicle 110 and the original location of the meet event (e.g., the waypoint 114D for the yielding vehicle 110) and/or between the passing vehicle 112 and the original location of the meet event (e.g., the waypoint 114F for the passing vehicle 112).

The confidence parameter may be inversely related to the closing distance of the yielding and/or passing vehicle 110, 112. For example, the confidence parameter may be smaller for a larger closing distance (e.g., the yielding vehicle 110 is farther from the meet location) and the confidence parameter may increase as the closing distance decreases (e.g., as the yielding vehicle 110 moves toward the meet location). The confidence parameter may be inversely related to the closing distance because, as the vehicle 110 and/or 112 is farther from the location of the meet event, there can be a greater possibility or chance that the yielding vehicle 110 has additional scheduled or unscheduled delays in arriving at the meet event. A scheduled delay may include a scheduled stop of the yielding vehicle 110 (e.g., to drop off and/or pick up passengers or cargo). An unscheduled delay may include an unplanned obtrusion blocking the main line route 104, a change in the movement plan for the yielding vehicle 110 to cause another vehicle having a higher priority than the yielding vehicle 110 to travel along the main line route 104 shown in FIG. 4 ahead of the yielding vehicle 110, unforeseen damage to the main line route 104, and the like.

In one embodiment, the confidence parameter has a value that is based on the number of potential alternate locations for meet events between the originally scheduled location of a meet event and one or more of the vehicles 110, 112. For example, with respect to the embodiment shown in FIG. 4, if the location of the original meet event is the second siding section route 106B, then a single alternate meet event location is provided between the yielding vehicle 110 and the original location (e.g., the first siding section route 106A) and between the passing vehicle 112 and the original location (e.g., the third siding section route 106C). In another example, if the location of the original meet event is the first siding section route 106A, then no alternate meet event locations are provided between the yielding vehicle 110 and the original location and two alternate meet event locations are disposed between the passing vehicle 112 and the original location (e.g., the second and third siding section routes 106B, 106C). As another example, if the location of the original meet event is the third siding section route 106C, then two alternate meet event locations are provided between the yielding vehicle 110 and the original location (e.g., the first and second siding section routes 106A, 106B) and no alternate meet locations are disposed between the passing vehicle 112 and the original location.

The modification module 208 (shown in FIG. 2) may calculate the confidence parameter based on an inverse relationship between the number of alternate locations for meet events between the originally scheduled location for a meet event and the current location of the yielding vehicle 110 and/or the passing vehicle 112. For example, the confidence parameter may have a relatively low value when several alternate locations for the meet event (e.g., other siding section routes 106) are disposed between the yielding vehicle 110 (or the passing vehicle 112) and the original location of the meet event. The confidence parameter can increase in value as the yielding vehicle 110 (or the passing vehicle 112) moves toward the original location of the meet event. For example, the confidence parameter may have a value that increases as fewer alternate locations for the meet event are disposed between the yielding vehicle 110 (or the passing vehicle 112) and the original location of the meet event. The confidence parameter can increase in value as the yielding vehicle 110 (or the passing vehicle 112) moves toward the original location of the meet event.

In one embodiment, the confidence parameter has an initial value when no alternate locations for the meet event are located between the current location of the yielding vehicle 110 (or the passing vehicle 112) and the original location of the meet event. This initial value can be 1.0, 100%, or some other number. The value of the confidence parameter can decrease as more alternate locations for the meet event are disposed between the current location of the yielding vehicle 110 (or the passing vehicle 112) and the original location of the meet event. The relationship between the confidence parameter and the closing distance between the yielding vehicle 110 (or the passing vehicle 112) and the original location of the meet event may be a linear relationship. For example, the confidence parameter may decrease by a fixed or predetermined amount for each unit of distance and/or for each alternate location of a meet event in the closing distance between the yielding vehicle 110 (or the passing vehicle 112) and the original location of the meet event. Alternatively, the relationship between the confidence parameter and the closing distance between the yielding vehicle 110 (or the passing vehicle 112) and the original location of the meet event may be a non-linear relationship. For example, the confidence parameter may decrease by a changing or different amount for each unit of distance and/or for each alternate location of a meet event in the closing distance between the yielding vehicle 110 (or the passing vehicle 112) and the original location of the meet event.

Table 1 below illustrates examples of different confidence parameters that may be calculated based on the closing distance or number of alternate locations for the meet event between the current location of the yielding vehicle 110 and the original location of the meet event:

TABLE 1

| Closing Distance | Number of Alternate Meet Event Locations | Confidence Parameter #1 (linear relationship) | Confidence Parameter #2 (non-linear relationship) |
|---|---|---|---|
| 4 waypoints (e.g., 30 miles or 48 kilometers) | 4 | 65% | 70% |
| 3 waypoints (e.g., 25 miles or 40 kilometers) | 3 | 70% | 75% |
| 2 waypoints (e.g., 20 miles or 32 kilometers) | 2 | 80% | 85% |
| 1 waypoint (e.g., 15 miles or 24 kilometers) | 1 | 85% | 90% |
| 0 waypoints (e.g., less than 10 miles or 16 kilometers) | 0 | 90% | 95% |

In the Table 1, the first column lists different closing distances between the yielding vehicle 110 (or the passing vehicle 112) and the original location of the meet event. The closing distances are expressed in the number of waypoints 114, such as the number of scheduled waypoints 114 disposed between the current location of the yielding or passing vehicle 110, 112 and the original location of the meet event. Alternatively, the closing distances can be expressed in the actual distance between the current location of the yielding or passing vehicle 110, 112 and the original location of the meet event.

In another embodiment, the closing distance used by the modification module 208 (shown in FIG. 2) to calculate the confidence parameter is based on the number of alternate locations for the meet event (e.g., alternate siding section routes 106) within the closing distance between the yielding vehicle 110 (or the passing vehicle 112) and the original location of the meet event. The second column in Table 1 lists different closing distances between the yielding vehicle 110

(or the passing vehicle 112) and the original location of the meet event. The closing distances are expressed in the number of alternate siding section routes 106 disposed between the current location of the yielding or passing vehicle 110, 112 and the original location of the meet event. With respect to the embodiment shown in FIG. 4, if the original location of a meet event is the third siding section route 106C, then the closing distance between the yielding vehicle 110 and the original location may be expressed as two, or two alternate locations for the meet event. With respect to the passing vehicle 112, the closing distance between the passing vehicle 112 and the original location may be expressed as zero, or no alternate loc locations for the meet event.

The third column lists examples of corresponding confidence parameters that may be calculated by the modification module 208 (shown in FIG. 2) based on the closing distances in the first column. As shown in the third column, the confidence parameters may increase at a linear rate based on the decreasing distance between the yielding vehicle 110 (or the passing vehicle 112) and the original location of the meet event as the yielding vehicle 110 (or the passing vehicle 112) approaches the original location of the meet event. Alternatively, the fourth column lists examples of confidence parameters that may be calculated by the modification module 208 based on the closing distances in the first column according to a non-linear relationship. As shown in the fourth column, the confidence parameters may increase at a non-linear rate based on the decreasing distance between the yielding vehicle 110 (or the passing vehicle 112) and the original location of the meet event as the yielding vehicle 110 (or the passing vehicle 112) approaches the original location of the meet event. The closing distances and the confidence parameters provided in Table 1 are provided merely as examples and are not intended to be limiting on all embodiments described herein. For example, other relationships or calculations may be used to determine the confidence parameters based on the closing distance.

The modification module 208 (shown in FIG. 2) can compare the confidence parameter to one or more predetermined confidence thresholds to determine if the scheduled time and/or location of the original meet location can be changed to an updated time and/or location. For example, with respect to changing the time of the meet event, the modification module 208 may examine the confidence parameters to determine if time of the meet event can be delayed without adversely impacting the throughput parameter of the transportation network 102.

In one embodiment, if the confidence parameter exceeds the confidence threshold, then the confidence parameter may indicate that the meet event can be modified, such as by delaying the scheduled time of the meet event for the yielding vehicle 110, without significantly impacting or decreasing the throughput parameter of the transportation network 102. On the other hand, if the confidence parameter does not exceed the confidence threshold, then the confidence parameter may indicate that the meet event cannot be modified, such as by delaying the scheduled time of the meet event for the yielding vehicle 110, without significantly impacting or decreasing the throughput parameter of the transportation network 102. If the confidence parameter exceeds the confidence threshold, then the modification module 208 (shown in FIG. 2) changes the originally scheduled time of the meet event to an updated scheduled time of the meet event. The updated scheduled time may be based on an estimated time of arrival (ETA) of the yielding vehicle 110, the ETA of the passing vehicle 112, and/or a predetermined slack time period, among other factors.

The ETA of the yielding and/or passing vehicle 110, 112 represents the time at which the yielding and/or passing vehicle 110, 112 is expected to arrive at the location of the meet event. In order to calculate the ETA of the yielding or passing vehicle 110, 112, the modification module 208 may determine the closing distance between the yielding or passing vehicle 110, 112 and the location of the meet event, as well as the speed of the yielding or passing vehicle 110, 112. In one embodiment, the modification module 208 assumes that the yielding or passing vehicle 110, 112 is traveling at a predetermined speed, such as route speed, or the speed limit that is allowed on the section of the main line route 104 that the yielding or passing vehicle 110, 112 is traveling. Alternatively, the yielding or passing vehicle 110, 112 may periodically or continually transmit the current speed of the yielding or passing vehicle 112 to the modification module 208 via the antenna 116 (shown in FIG. 1) of the scheduling system 100 (shown in FIG. 1). The ETA of the yielding and/or passing vehicle 110, 112 may then be calculated or estimated based on the speed and closing distance to the meet event.

The slack time period may be a scheduled period of time between arrival of the yielding vehicle 110 at the location of the meet event and arrival of the passing vehicle 112 at the meet event. Alternatively, the slack time period may be a scheduled period of time between the yielding vehicle 110 being off of the main line route 104 and completely onto the siding section route 106 and arrival of the passing vehicle 112 at the meet event. The location of the yielding vehicle 110 may be the intersection between the main line route 104 and the siding section route 106 of the meet event where the yielding vehicle 110 moves off of the main line route 104. The slack time period is a safety buffer of time that is built into the schedules of the yielding and passing vehicles 110, 112 as a precaution against the yielding and/or passing vehicles 110, 112 arriving too early at a meet event and risking collision between the yielding and passing vehicles 110, 112.

In one embodiment, the modification module 208 (shown in FIG. 2) changes the scheduled time of the meet event by delaying, or pushing back, the scheduled time of the meet event for the yielding vehicle 110. The modification module 208 can delay the scheduled time of the meet event by an amount of time that results in the yielding vehicle 110 arriving at the meet event by at least the slack time period before the passing vehicle 112 arrives at the meet event. For example, the movement plan may include an original meet event that occurs at the second siding section route 106B with the yielding vehicle 110 scheduled to arrive at the waypoint 114D at 12:00 noon and the passing vehicle 112 scheduled to arrive at the waypoint 114E at 12:15 pm, with a 15 minute slack time period built into the movement plan between the arrivals of the yielding and passing vehicles 110, 112. The movement plan may further include directions to the yielding vehicle 110 to move to the waypoint 114E on the siding section route 106B. The modification module 208 can examine the speed of the passing vehicle 112 and determine that the passing vehicle 112 is delayed by 20 minutes such that the passing vehicle 112 is not due to arrive at the meet event (e.g., the waypoint 114F) until 12:35 pm. In order to maintain the 15 minute slack time period between the arrivals of the yielding and passing vehicles 110, 112, the modification module 208 may determine that the originally scheduled time of the meet event for the yielding vehicle 110 can be delayed to 12:20 pm.

In another embodiment, the modification module 208 (shown in FIG. 2) changes the scheduled time of the meet event by delaying, or pushing back, the scheduled time of the meet event for the passing vehicle 112. The modification module 208 can delay the scheduled time of the meet event by an amount of time that results in the passing vehicle 112 arriving at the meet event by at least the slack time period after the yielding vehicle 110 arrives at the meet event. With respect to the yielding vehicle 110, the term "arriving at the meet event," and the derivations thereof, can mean that the yielding vehicle 110 is entirely disposed off of the main line route 104 and/or entirely disposed on the siding section route 106 such that the passing vehicle 112 can pass the siding section route 106 without colliding with the yielding vehicle 110. For example, the movement plan may include an original meet event that occurs at the third siding section route 106C with the yielding vehicle 110 scheduled to arrive at the waypoint 114G at 1:00 pm and the passing vehicle 112 arriving at the waypoint 114I at 1:10 pm, with a 10 minute slack time period built into the movement plan between the arrivals of the yielding and passing vehicles 110, 112. The movement plan may further include directions to the yielding vehicle 110 to move to the waypoint 114H on the siding section route 106C. The modification module 208 can examine the speed of the yielding vehicle 110 and determine that the yielding vehicle 110 is delayed by 30 minutes such that the yielding vehicle 110 is not due to arrive at the meet event (e.g., the waypoint 114G) until 1:30 pm. For example, the yielding vehicle 110 may not get entirely off of the main line route 104 and entirely onto the siding section route 106 until 1:30 pm. In order to maintain the 10 minute slack time period between the arrivals of the yielding and passing vehicles 110, 112, the modification module 208 may determine that the originally scheduled time of the meet event for the passing vehicle 112 can be delayed to 1:40 pm.

With respect to changing the location of the meet event, the modification module 208 (shown in FIG. 2) may examine the confidence parameters to determine if the location of the meet event can be changed to another location without adversely impacting the throughput parameter of the transportation network 102. The location of the meet event may be changed from the originally scheduled location due to a variety of factors. For example, one or more of the yielding and/or passing vehicles 110, 112 may be travelling significantly behind or ahead of the associated schedules of the movement plan. The location of the meet event may be changed by directing the yielding vehicle 110 to move to a different siding section route 106 than the original siding section route 106 of the meet event. If the confidence parameter exceeds the confidence threshold, then the confidence parameter may indicate that the location of the meet event can be modified to another location without significantly impacting or decreasing the throughput parameter of the transportation network 102. If the confidence parameter does not exceed the confidence threshold, then the confidence parameter may indicate that the location meet event cannot be changed to another location without significantly impacting or decreasing the throughput parameter of the transportation network 102.

The modification module 208 (shown in FIG. 2) can calculate a plurality of confidence parameters for different alternate locations for a meet event. The modification module 208 may calculate the confidence parameters for two or more siding section routes 106 that are joined with the main line route 104 on which the yielding and/or passing vehicles 110, 112 are travelling and that are located between the current location of the yielding and/or passing vehicles 110, 112 and the originally scheduled location of the meet event. With respect to the embodiment shown in FIG. 4, the modification module 208 can calculate confidence parameters for each of the first, second, and third siding section routes 106A, 106B, 106C. The modification module 208 may calculate the confidence parameters for each of the siding section routes 106A, 106B, 106C at the same time or at approximately the same time based on the current locations of the yielding and/or passing vehicles 110, 112. For example, the modification module 208 can calculate a first confidence parameter for the first siding section route 106A, a second confidence parameter for the second siding section route 106B, and a third confidence parameter for the third siding section route 106C based on the current position of the yielding vehicle 110. The several confidence parameters that are calculated based on the current location of the yielding vehicle 110 may be referred to as a first set of confidence parameters and the confidence parameters calculated based on the current location of the passing vehicle 112 may be referred to as a second set of confidence parameters. Different sets of the confidence parameters may be calculated for the yielding and/or passing vehicle 110, 112 as the yielding and/or passing vehicle 110, 112 travels in the transportation network 102.

The modification module 208 (shown in FIG. 2) compares the plurality of confidence parameters calculated for different potential alternate locations for the meet events with each other in one embodiment. The modification module 208 may identify a confidence parameter of the set of confidence parameters associated with the current location of the yielding or passing vehicle 110, 112 that is greater than one or more, or all, of the other confidence parameters in the set. The identified confidence parameter is associated with one of the potential locations for the meet event.

If the potential location associated with the identified confidence parameter is a different location than the original location of the meet event, then the identified confidence parameter may indicate that changing the original location of the meet event to the location associated with the identified confidence parameter is unlikely to reduce the throughput parameter of the transportation network 102. The identified confidence parameter also may indicate that changing the location of the meet event to another location that is not associated with the identified confidence parameter or keeping the original location of the meet event may increase or is likely to reduce the throughput parameter of the transportation network. If the potential location associated with the identified confidence parameter is the same location as the original location of the meet event, then the identified confidence parameter may indicate that keeping the original location of the meet event is unlikely to reduce the throughput parameter of the transportation network 102. The identified confidence parameter also may indicate that changing the location of the meet event to another location that is not associated with the identified confidence parameter may increase or is likely to reduce the throughput parameter of the transportation network.

The modification module 208 (shown in FIG. 2) can compare the identified confidence parameter to a predetermined threshold to determine if changing the location of the meet event will reduce or is likely to reduce the throughput parameter of the transportation network 102. If the identified confidence parameter exceeds the threshold, then the identified confidence parameter may indicate that changing the location of the meet event to the location associated with the identified confidence parameter (or keeping the same location for the meet event) may not reduce or is unlikely to reduce the throughput parameter of the transportation network 102. On the other hand, if the identified confidence parameter does not exceed the threshold, then the identified confidence parameter may indicate that changing the location of the meet event to the location associated with the identified confidence parameter (or keeping the same location for the meet event)

may reduce or is likely to reduce the throughput parameter of the transportation network 102.

In another embodiment, the confidence parameters calculated by the modification module 208 (shown in FIG. 2) may be adjusted based on one or more unscheduled conditions. An unscheduled condition can include an event or occurrence that impacts the movement plan of the transportation network 102. One example of an unscheduled condition can be a damaged portion of the routes 104 and/or 106. For example, a previously unknown portion of the route 104 and/or 106 may be damaged and, as a result, the vehicles 108, 110, 112 cannot travel to a meet event through the damaged portion of route 104, 106, cannot use a damaged portion of a siding section route 106 for a meet event, and/or must travel slower across the damaged portion of the route 104, 106. Another example of an unscheduled condition may be an unplanned obtrusion blocking the route 104, 106, a change in the movement plan for one or more of the yielding and/or passing vehicles 110, 112 due to another, higher priority, vehicle traveling along a common portion of the route 104 as the yielding and/or passing vehicle 110, 112 (and potentially requiring the yielding and/or passing vehicle 110, 112 to move to a siding section route 106), and the like. The modification module 208 may decrease the value of one or more confidence parameters based on an unscheduled condition. For example, the confidence parameter associated with a damaged siding section route 106 may be decreased. Alternatively, the modification module 208 may increase the value of one or more confidence parameters based on an unscheduled condition. For example, the confidence parameter associated with a damaged siding section route 106 may remain unchanged while the confidence parameters associated with other siding section routes 106 are increased. The amount of change to the confidence parameters may be a predetermined amount or may be based on the type and/or location of the unscheduled condition.

Returning to the discussion of the scheduling system 100 shown in FIGS. 1 and 2, the modification module 208 can determine an updated time and/or updated location for the originally scheduled meet event based on the confidence parameters described above. An "updated meet event" includes an original meet event whose time and/or schedule have been changed by the modification module 208. The modification module 208 communicates the updated meet event (e.g., the updated time and/or updated location) to the communication module 210. The communication module 210 determines which vehicles 108, 110, 112 in the transportation network 102 are to receive the updated time and/or updated location of the updated meet event. In one embodiment, the modification module 208 addresses the updated meet event to one or more of the vehicles 108, 110, 112 having schedules that are modified based on the updated meet event. For example, the modification module 208 can address the updated time of the meet event to the yielding vehicle 110 by associating the updated meet event with a unique identification number of the yielding vehicle 110.

The communication module 210 identifies which vehicle 108, 110, 112 are addressed by the updated meet event and transmits the updated meet event to the addressed vehicle 108, 110, 112. For example, the communication module 210 may wirelessly transmit the updated time of the updated meet event to the yielding vehicle 110. The modification module 208 can generate several updated meet events at the same time or at approximately the same time. The communication module 210 transmits the updated meet events to the several vehicles 108, 110, 112 having schedules that are affected by the updated meet event. The communication module 210 can transmit the updated meet events to the vehicles 108, 110, 112 as the vehicles 108, 110, 112 are moving toward the meet events. For example, instead of communicating the updated meet events when the vehicles 108, 110, 112 are stationary, the communication module 210 can transmit the updated meet events as the vehicles 108, 110, 112 are in motion and progressing toward the meet events that are updated.

The vehicles 108, 110, 112 to whom the updated meet events are addressed receive the updated meet events and may change operations in response thereto. For example, one or more of the vehicles 108, 110, 112 may reduce tractive efforts to slow down the one or more of the vehicles 108, 110, 112 to arrive at the updated meet event at the updated time and/or location. In one embodiment, the antenna 118 of the yielding vehicle 110 receives the updated meet event from the scheduling system 100. The energy management system 120 in the yielding vehicle 110 examines the updated meet event to determine if the tractive effort and/or braking effort of the yielding vehicle 110 should be changed based on the updated meet event. For example, if the updated meet event includes a delayed time for the yielding vehicle 110 to arrive at the meet event, then the energy management system 120 may determine that the yielding vehicle 110 can slow down or reduce speed and conserve fuel in order to arrive at the updated meet event at the updated time. As a result, the energy management system 120 generates a directive to an operator to reduce a throttle setting to be displayed on the display device 124 and/or automatically reduces the throttle setting of the propulsion subsystem 122, for example. The yielding vehicle 110 may then reduce speed and fuel consumption while arriving at the meet event at the updated time. Alternatively, the energy management system 120 may change which siding section route 106 is used by the yielding and/or passing vehicle 110, 112 for the updated meet event. The updated location may be visually presented to the operator of the yielding and/or passing vehicle 110, 112 and/or used by the energy management system 120 to direct the yielding and/or passing vehicle 110, 112 to proceed to the updated location of the meet event.

In another embodiment, the antenna 118 of the passing vehicle 112 receives the updated meet event from the scheduling system 100. The energy management system 120 in the passing vehicle 112 examines the updated meet event to determine if the tractive effort and/or braking effort of the passing vehicle 112 should be changed based on the updated meet event. For example, the updated meet event may include a delayed time for the passing vehicle 112 to arrive at the meet event when the yielding vehicle 110 is behind schedule and may not entirely exit off of the main line route 104 before the originally scheduled meet event. In order to avoid the passing vehicle 112 having to abruptly slow down (e.g., by having the operator take control of the passing vehicle 112 such that the energy management system 120 does not control tractive efforts of the passing vehicle 112) and/or stop, the scheduling system 100 may instruct the passing vehicle 112 of an updated time of the meet event.

The energy management system 120 may determine that the passing vehicle 110 can slow down or reduce speed and conserve fuel in order to arrive at the updated meet event at the updated time. As a result, the energy management system 120 generates a directive to an operator to reduce a throttle setting to be displayed on the display device 124 and/or automatically reduces the throttle setting of the propulsion subsystem 122, for example. The passing vehicle 112 may then reduce speed and fuel consumption while arriving at the meet event at the updated time such that the yielding vehicle 110 is able to pull off of the main line route 104 and onto the siding section route 106 in time.

By slowing down the passing vehicle 112 under the control of the energy management system 120 instead of the operator or other system taking control of the energy management system 120 (e.g., to abruptly slow down), less fuel may be consumed in getting the passing vehicle 112 to the updated meet event. For example, if an updated time is not determined by the scheduling system 100, an operator on the passing vehicle 112 may abruptly slow down or stop movement of the passing vehicle 112 to avoid arriving at the meet event before the yielding vehicle 110 is able to pull off of the main line route 104. The operator may do so when a yellow or red signal light is seen alongside the main line route 104. The abrupt slowing down or stopping of the passing vehicle 112 may cause the energy management system 120 to stop controlling the tractive efforts of the passing vehicle 112 in an energy or fuel efficient manner, which can result in additional fuel being consumed than would be consumed if the energy management system 120 maintained control of the passing vehicle 112.

In another embodiment of the inventive subject matter disclosed herein, the movement plan for a transportation network can include pass events between two or more vehicles. A pass event can occur when first and second vehicles simultaneously travel in the same (e.g., common) direction on the same main section of a route with the first vehicle leading the second vehicle, and the first vehicle pulls off of the main section of the route onto a siding section of the route to allow the second vehicle to pass the first vehicle along the main section of the route. The pass event can be defined as a location and time at which the second vehicle (referred to herein as the "overtaking vehicle") is scheduled to pass the first vehicle (referred to herein as the "leading vehicle") on a common section of a route. For example, a pass event can include a location in the transportation network that includes a main line of a rail track having a siding section of the track. During the pass event, the leading vehicle moves off of the main line of the track to the siding section of the track and may stop or slow while the overtaking vehicle continues to move along the main line track and pass the leading vehicle.

As described above, a scheduling system can monitor a throughput parameter of the transportation network. The scheduling system can determine a confidence parameter that represents a probability that changing a speed of one or more vehicles arriving at a pass event will not negatively impact the throughput parameter. For example, if the overtaking vehicle is a faster vehicle than the leading vehicle and is relatively close behind the leading vehicle, the scheduling system may determine a low probability that slowing the overtaking vehicle will negatively impact (e.g., reduce) the throughput parameter. As another example, if the leading vehicle is relatively far ahead of the overtaking vehicle, the scheduling system may determine a low probability that slowing the leading vehicle will negatively impact the throughput parameter.

Similar to modifying a meet event, the scheduling system can modify the pass event and transmit the modified pass event to one or more of the vehicles. The vehicles may proceed toward the pass event based on the modified details. For example, the overtaking vehicle may slow down to arrive at the pass event later than originally scheduled. As another example, the passing vehicle may slow down to arrive at the pass event later than originally scheduled. The slowing of the overtaking vehicle or the leading vehicle can increase fuel savings while avoiding significant increases in the congestion of the transportation network.

Returning to the discussion of FIG. 1, the siding section routes 106 may be used for the pass events. For example, a leading vehicle 108, 110, 112 and an overtaking vehicle 108, 110, 112 may travel the same direction along the main line route 104 at the same time, with the leading vehicle 108, 110, 112 ahead of the overtaking vehicle 108, 110, 112 along the direction of travel. The leading vehicle 108, 110, 112 may pull off of the main line route 104 and onto a siding section route 106 as the overtaking vehicle 108, 110, 112 continues on and passes the leading vehicle 108, 110, 112 on the main line route 104. Once the overtaking vehicle 108, 110, 112 has passed, the leading vehicle 108, 110, 112 may travel from the siding section route 106 back onto the main line route 104 and continue along the main line route 104 behind the overtaking vehicle 108, 110, 112.

Figure 5:
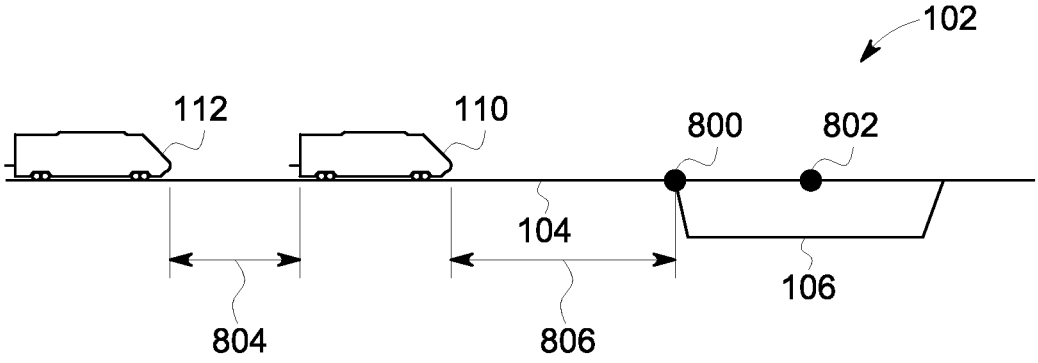
FIG. 5 is a schematic diagram of another section of one embodiment of the transportation network shown in FIG. 1.

FIG. 5 is a schematic diagram of a section of one embodiment of the transportation network 102 shown in FIG. 1. The illustrated section includes a portion of the main line route 104 and a siding section route 106. The vehicles 110, 112 are traveling in the same direction on the main line route 104, with the vehicle 110 being the leading vehicle and the vehicle 112 being the overtaking vehicle (e.g., the vehicle that will pass the vehicle 110 at the pass event). The vehicles 110, 112 are shown in FIG. 5 without the non-powered units 128 (shown in FIG. 1). The vehicles 110, 112 and routes 104, 106 are not drawn to scale in FIG. 5.

An originally scheduled pass event may be in the schedule of the leading vehicle 110 in a manner that directs the leading vehicle 110 to move to the siding section route 106 at a scheduled waypoint 800 (e.g., the intersection of the siding section route 106 and the main line route 104 that is closer to the vehicles 110, 112) at a scheduled time and remain on the siding section route 106 (e.g., slow down and/or stop) until the overtaking vehicle 112 passes the siding section route 106 on the main line route 104. The schedule may then direct the leading vehicle 110 to travel back onto the main line route 104 and proceed to another scheduled waypoint. With respect to the overtaking vehicle 112, the schedule may direct the overtaking vehicle 112 to proceed to and pass the siding section route 106 at a scheduled time at a scheduled waypoint 802.

The original pass event between the leading vehicle 110 and the overtaking vehicle 112 in the movement plan may be modified by the scheduling system 100 (shown in FIG. 1) to conserve fuel or other energy consumed by the vehicles 110, 112. For example, the originally scheduled time or location of the pass event can be modified to an updated time and/or location. In one embodiment, if the overtaking vehicle 112 is relatively close to the leading vehicle 110 (e.g., is relatively close behind the leading vehicle 110), then the overtaking vehicle 112 may slow down to arrive at the pass event (e.g., the waypoint 800) at a later time than originally scheduled. The leading vehicle 110 may proceed as originally scheduled to pull off to the siding section route 106 to allow the overtaking vehicle 112 to pass. The reduced speed of the overtaking vehicle 112 can allow the overtaking vehicle 112 to consume less fuel while still passing the leading vehicle 110 at the pass event. In another example, if the leading vehicle 110 is relatively far ahead of the overtaking vehicle 112, then the leading vehicle 110 may slow down to arrive at the pass event later than originally scheduled. The leading vehicle 110 may proceed to pull off to the siding section route 106 to allow the overtaking vehicle 112 to pass. The reduced speed of the leading vehicle 110 can allow the leading vehicle 110 to consume less fuel while still allowing the overtaking vehicle 112 to pass.

In order to modify the time of the original pass event to an updated time, the modification module 208 (shown in FIG. 2) of the scheduling system 100 (shown in FIG. 1) determines a confidence parameter that changing the time of the original pass event does not negatively impact the throughput parameter of the transportation network 102 (shown in FIG. 1). For example, the modification module 208 determines the probability that changing a scheduled time of the pass event for the leading vehicle 110 and/or the overtaking vehicle 112 will not decrease the throughput parameter of the transportation network 102.

If the confidence parameter determined by the modification module 208 (shown in FIG. 2) is sufficiently high, the modification module 208 can delay the original time of the pass event to an updated or delayed time. The relatively high confidence parameter can indicate that modifying the time of the original pass event will not negatively impact the throughput parameter of the transportation network 102 (shown in FIG. 1). On the other hand, if the confidence parameter is too low, then the confidence parameter can indicate that modifying the time of the original pass event may negatively impact the throughput parameter.

In one embodiment, the confidence parameter is based on one or more of relative speeds of the leading vehicle 110 and the overtaking vehicle 112, a separation distance 804 between the leading vehicle 110 and the overtaking vehicle 112, and/or a closing distance 806 between the leading vehicle 110 and the siding section route 106 where the pass event is scheduled to occur. The speeds of the leading vehicle 110 and the overtaking vehicle 112 may be transmitted by the leading vehicle 110 and the overtaking vehicle 112 to the monitoring module 204 (shown in FIG. 2), such as in a periodic manner. Alternatively, the monitoring module 204 may track the speeds of the leading vehicle 110 and the overtaking vehicle 112 and calculate the relative speeds based thereon. The term "relative speeds" can include the differences in the speeds of the leading vehicle 110 and the overtaking vehicle 112. For example, if the leading vehicle 110 is traveling 70 miles per hour and the overtaking vehicle 112 is traveling 75 miles per hour in the same direction, then the relative speed of the leading vehicle 110 to the overtaking vehicle 112 is −5 miles per hour and the relative speed of the overtaking vehicle 112 to the leading vehicle 110 is +5 miles per hour.

The separation distance 804 can be measured as the distance between the overtaking vehicle 112 and the leading vehicle 110 along the main line route 104. For example, if the main line route 104 includes one or more turns or bends between the overtaking vehicle 112 and the leading vehicle 110, then the separation distance 804 may be measured along a corresponding path that includes the turns or bends and may not necessarily be the shortest distance between the overtaking vehicle 112 and the leading vehicle 110. In the illustrated embodiment, the separation distance 804 is shown as extending between the front or leading end of the overtaking vehicle 112 and the back or trailing end of the leading vehicle 110. However, if the overtaking vehicle 112 includes one or more other vehicles or cars joined or coupled with the overtaking vehicle 112 and disposed between the overtaking vehicle 112 and the leading vehicle 110, then the separation distance 804 may be measured from the front or leading end of the other vehicles and the back or trailing end of the leading vehicle 110. If the leading vehicle 110 includes one or more other vehicles or cars joined or coupled with the leading vehicle 110 and disposed behind the leading vehicle 110 and between the leading vehicle 110 and the overtaking vehicle 110, then the separation distance 804 may be measured from the back or trailing end of the other vehicles and the front or leading end of the overtaking vehicle 112.

The closing distance 806 can be measured as the distance between the leading vehicle 110 and the location of the pass event (e.g., the waypoint 800 at which the leading vehicle 110 pulls off of the main line route 104) along the main line route 104. As described above, if the main line route 104 includes one or more turns or bends between the leading vehicle 110 and the location of the pass event, then the closing distance 806 may be measured along a corresponding path that includes the turns or bends. In the illustrated embodiment, the closing distance 806 is shown as extending between the front or leading end of the leading vehicle 110 and the waypoint 800. If the leading vehicle 110 includes one or more other vehicles or cars joined or coupled with the leading vehicle 110 and disposed between the leading vehicle 110 and the waypoint 800, then the closing distance 806 may be measured from the front or leading end of the other vehicles and the waypoint 800.

The relative speeds of the leading vehicle 110 and the overtaking vehicle 112, the separation distance 804, and/or the closing distance 806 may be obtained by the monitoring module 204 (shown in FIG. 2) and communicated to the modification module 208 (shown in FIG. 2). For example, the monitoring module 204 may periodically identify locations of the leading vehicle 110 and the overtaking vehicle 112 and use the locations and/or time periods between identified locations to determine the relative speeds, the separation distance 804, and/or the closing distance 806.

The confidence parameter may have a positive relationship or a direct relationship with at least one of the relative speeds of the leading vehicle 110 and/or the overtaking vehicle 112. For example, the confidence parameter may increase when the relative speed of the overtaking vehicle 112 to the leading vehicle 110 increases. The relationship between the confidence parameter and one or more of the relative speeds is a positive relationship when an increase in the one or more of the relative speeds results in a linear (e.g., proportional) or non-linear (e.g., non-proportional) increase in the confidence parameter. In one embodiment, the confidence parameter has a positive relationship with the relative speed of the overtaking vehicle 112 to the leading vehicle 110. For example, if the overtaking vehicle 112 is traveling faster than the leading vehicle 110, then the confidence parameter may be larger than when the overtaking vehicle 112 is traveling closer to the speed of the leading vehicle 110 or slower than the leading vehicle 110. The confidence parameter may increase when the overtaking vehicle 112 is traveling faster than the leading vehicle 110 because delaying the time of the pass event such that the overtaking vehicle 112 slows down may not negatively impact other vehicles in the network. For example, in order to avoid a collision with the leading vehicle 110 or to avoid coming too close to the leading vehicle 110, the overtaking vehicle 112 may need to slow down and such slowing down may not negatively impact the throughput parameter because the throughput parameter may already be negatively impacted by the slower speed of the leading vehicle 110.

The confidence parameter may have a negative relationship or inverse relationship with the relative speed of the leading vehicle 110 to the overtaking vehicle 112. For example, if the leading vehicle 110 is traveling faster than the overtaking vehicle 112, then the confidence parameter may be smaller than when the leading vehicle 110 is traveling closer to the speed of the overtaking vehicle 112 or slower than the overtaking vehicle 112. The confidence parameter may decrease when the leading vehicle 110 is traveling faster than the overtaking vehicle 112 because delaying the time of the pass event may result in both the leading vehicle 110 and the overtaking vehicle 112 both slowing down. When both vehicles 110, 112 slow down, more vehicles may be delayed within the network.

As one example, the overtaking vehicle 112 may travel faster than the leading vehicle 110 such that the overtaking vehicle 112 may reach the leading vehicle 110 before the leading vehicle 110 reaches the siding section route 106 or that the overtaking vehicle 112 comes within a safety buffer distance from the leading vehicle 110 before the leading vehicle 110 reaches the siding section route 106. The relatively large relative speed of the overtaking vehicle 112 to the leading vehicle 110 may result in calculation by the modification module 208 (shown in FIG. 2) of a relatively high confidence parameter that delaying the time of the pass event will not decrease the throughput parameter of the network. For example, the time of the pass event can be delayed such that the overtaking vehicle 112 can slow down to avoid colliding with the leading vehicle 110 or coming within the safety buffer distance to the leading vehicle 110. The speed of the overtaking vehicle 112 can be paced to the speed of the leading vehicle 110. Running the overtaking vehicle 112 as the reduced speed can decrease the fuel that is consumed by the overtaking vehicle 112.

The confidence parameter may have a positive relationship or a direct relationship with the separation distance 804. For example, as the separation distance 804 increases, the confidence parameter also may increase such that there is a decreased chance that delaying the pass event will negatively impact the throughput parameter. When the separation distance 804 is relatively large, the leading vehicle 110 may be able to slow down to arrive at the pass event at a delayed time (relative to the originally scheduled time) such that the overtaking vehicle 112 is closer to the leading vehicle 110 when the leading vehicle 110 arrives at the siding section route 106. The decreased speed of the leading vehicle 110 may not negatively impact the throughput parameter of the network as the leading vehicle 110 otherwise would have to wait at the siding section route 106 for the overtaking vehicle 112 to arrive and pass. For example, decreasing the speed of the leading vehicle 110 may not negatively impact the throughput parameter any more or slightly more than the leading vehicle 110 pulling off onto the siding section route 106 and waiting for the overtaking vehicle 112.

The confidence parameter may have a negative relationship or an inverse relationship with the closing distance 806. For example, as the closing distance 806 decreases, the confidence parameter may increase. The confidence parameter may be inversely related to the closing distance 806 because, as the vehicle 110 and/or 112 is farther from the location of the pass event, there can be a greater possibility or chance that the leading vehicle 110 has additional scheduled or unscheduled delays in arriving at the meet event. Similar to the confidence parameter for meet events, in one embodiment, the confidence parameter for pass events can have a value that is based on the number of potential alternate locations for pass events between the originally scheduled location of a pass event and one or more of the vehicles 110, 112. For example, the confidence parameter may be inversely related to the number of other siding section routes 106 between the current location of the leading vehicle 110 and the location of the siding section route 106 that is originally or previously scheduled for the pass event. As described above, the confidence parameter may have a relatively low value when several alternate locations for the pass event are disposed between the leading vehicle 110 and the original location of the pass event. The confidence parameter can increase in value as the passing vehicle 110 moves toward the original location of the pass event.

The confidence parameter may be impacted differently by different factors. Based on a combination of the relative speed of the overtaking vehicle 112 to the leading vehicle 110, the separation distance 804, and/or the closing distance 806, the confidence parameter may change in value differently than if only one or a subset of these factors were considered. For example, if the relative speed of the overtaking vehicle 112 to the leading vehicle 110 is positive (e.g., the overtaking vehicle 112 is traveling faster than the leading vehicle 110), the separation distance 804 is relatively large, then the confidence parameter may still be relatively high, even if the closing distance 806 is relatively large. As another example, if the separation distance 804 is relatively large and the closing distance 806 is relatively small, then the confidence parameter may still be relatively high, even if the relative speed of the overtaking vehicle 112 to the leading vehicle 110 is small or negative. In another example, if the relative speed of the overtaking vehicle 112 to the leading vehicle 110 is relatively large or positive and the closing distance 806 is relatively small, the confidence parameter may be small if the separation distance 804 is relatively small.

Similar to as described above, the modification module 208 (shown in FIG. 2) can compare the confidence parameter to one or more predetermined confidence thresholds to determine if the originally or previously scheduled time and/or location of the original meet event can be changed to an updated time and/or location. For example, with respect to changing the time of the pass event, the modification module 208 may examine the confidence parameter to determine if the time of the pass event can be delayed without adversely impacting the throughput parameter of the transportation network 102. As another example, the modification module 208 may compare the confidence parameters associated with different locations (e.g., different siding section routes 106) with each other and/or with a threshold to determine if the location of the pass event can be moved to another location without negatively impacting the throughput parameter.

In one embodiment, if the confidence parameter exceeds the confidence threshold, then the confidence parameter may indicate that the pass event can be modified, such as by delaying the scheduled time of the pass event or changing which siding section route 106 is used for the pass event. On the other hand, if the confidence parameter does not exceed the confidence threshold, then the confidence parameter may indicate that the pass event cannot be modified without decreasing the throughput parameter of the transportation network 102. If the confidence parameter exceeds the confidence threshold, then the modification module 208 (shown in FIG. 2) changes the originally scheduled time and/or location of the pass event to an updated time and/or location of the pass event. The updated time and/or location may be based on an estimated time of arrival (ETA) of the yielding vehicle 110, the ETA of the passing vehicle 112, and/or a predetermined slack time period, among other factors, as described above.

For example, the ETA of the vehicle 110, 112 can represent the time at which the leading and/or overtaking vehicle 110, 112 is expected to arrive at the location of the pass event. The slack time period may be a scheduled period of time between arrival of the leading vehicle 110 at the location of the pass event and arrival of the overtaking vehicle 112 at the pass event. Alternatively, the slack time period may be a scheduled period of time between the leading vehicle 110 being off of the main line route 104 and completely onto the siding section route 106 and arrival of the overtaking vehicle 112 at the pass event. The modification module 208 can delay the scheduled time of the pass event by an amount of time that results in the passing vehicle 110 arriving at the pass event by at least the slack time period before the overtaking vehicle 112 arrives at the meet event. In another embodiment, the confidence parameters calculated by the modification module 208 (shown in FIG. 2) may be adjusted based on one or more unscheduled conditions, similar to as described above in connection with the meet events.

Returning to the discussion of the scheduling system 100 shown in FIGS. 1 and 2, the modification module 208 can determine an updated time and/or updated location for the originally scheduled pass event based on the confidence parameters described above. An "updated pass event" includes an original pass event whose time and/or schedule have been changed by the modification module 208. The modification module 208 communicates the updated pass event to the communication module 210. The communication module 210 determines which vehicles 108, 110, 112 in the transportation network 102 are to receive the updated time and/or updated location of the updated pass event. The communication module 210 transmits the updated pass event to the appropriate vehicle 108, 110, 112, as described above.

The vehicles 108, 110, 112 to whom the updated meet events are addressed receive the updated pass events and may change operations in response thereto. For example, control units (e.g., control unit 712 shown in FIG. 7) disposed onboard one or more of the vehicles 108, 110, 112 may reduce tractive efforts to slow down and to arrive at the updated pass event at the updated time and/or location. In one embodiment, one or more of the vehicles 108, 110, 112 receive the updated pass event and the energy management system 120 in the vehicles 108, 110, 112 that receive the updated pass event examine the updated pass event to determine if the tractive effort and/or braking effort of the vehicle 108, 110, 112 should be changed based on the updated pass event, similar to as described above. The energy management system 120 may determine that the corresponding vehicle 108, 110, 112 can slow down or reduce speed and conserve fuel in order to arrive at the updated pass event.

Figure 6:
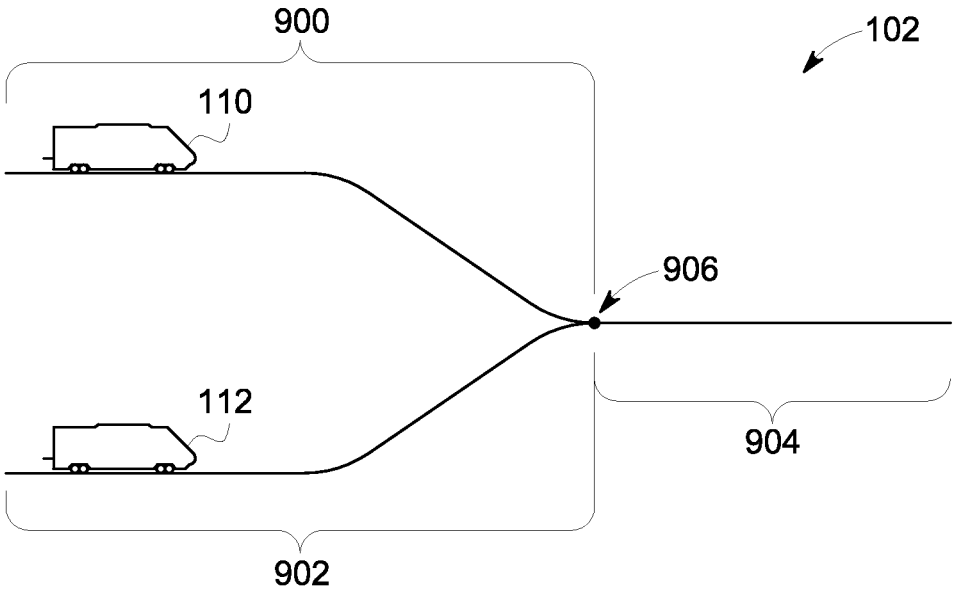
FIG. 6 is a schematic diagram of another section of one embodiment of the transportation network shown in FIG. 1.

FIG. 6 is another schematic diagram of a section of one embodiment of the transportation network 102 shown in FIG. 1. The illustrated section of the transportation network 102 includes a convergence between two routes. For example, two separate route sections 900, 902 of routes within the network 102 converge together into a single converged route section 904 of a route in the network 102. Each of the separate route sections 900, 902 can each represent different routes, such as different rail tracks, that can concurrently carry different vehicles 110, 112 traveling thereon (e.g., allow for travel of the vehicles 110, 112 on the different sections 900, 902 at the same time). The separate route sections 900, 902 merge into the single converged route section 904. For example, the separate route sections 900, 902 may join together into a single converged route section 904, such as a single rail track. The route sections 900, 902 merge together at a convergence point 906, which also may be referred to as an intersection between the route sections 900, 902. The convergence point 906 may be represented in the transportation network 102 shown in FIG. 1 by an intersection between two sections of the main line routes 104. For example, each of the separate route sections 900, 902 and the converged route section 904 may represent a different portion of the main line routes 104 shown in FIG. 1.

In the illustrated embodiment, a plurality of vehicles 110, 112, such as rail vehicles, may be concurrently traveling on the separate route sections 900, 902 toward the converged route section 904. The vehicles 110, 112 are shown in FIG. 6 without the non-powered units 128 (shown in FIG. 1). While the discussion herein focuses on rail vehicles, alternatively, the discussion may apply to vehicles other than rail vehicles. A movement plan of the transportation network 102 may include a convergence event between the vehicles 100, 112. A convergence event includes one of the vehicles 110 or 112 pulling onto the converged route section 904 ahead of the other of the vehicles 112 or 110 so that the vehicles 110, 112 can concurrently travel along the converged route section 904. For example, the convergence event may include the vehicle 110 pulling onto the converged route section 904 before the vehicle 112 so that the vehicles 110, 112 may proceed to travel along the converged route section 904 with the vehicle 110 traveling ahead of the vehicle 112. As used herein, the vehicle 110 that pulls onto the converged route section 904 ahead of another vehicle 112 is referred to as the "leading vehicle" while the other vehicle 112 that pulls onto the converged route section 904 behind the leading vehicle is referred to as the "following vehicle." The leading vehicle may travel ahead of the following vehicle in the same direction on the converged route section 904.

The movement plan for the transportation network 102 may include an originally scheduled convergence event that includes scheduled times and a scheduled location for the convergence event. The times of the convergence event may be the times that each of the vehicles 110, 112 is to proceed from the corresponding separate route section 900, 902 to the converged route section 904 (e.g., pass through the convergence point 906 onto the converged route section 904). The location for the convergence event may be the geographic location of the convergence point 906. The convergence point 906 may be a waypoint of the transportation network 102, such as one of the waypoints 114 (shown in FIG. 1).

An original convergence event between the vehicles 110, 112 in the movement plan may be modified by the scheduling system 100 (shown in FIG. 1) to conserve fuel or other energy consumed by the vehicles 110, 112. For example, the scheduled time of the convergence event can be modified to an updated time. In one embodiment, if the following vehicle 112 (e.g., the vehicle 112 that will follow the vehicle 110 on the converged route section 906) is traveling to arrive at the convergence point 906 before the leading vehicle 110 (e.g., the vehicle 110 that will lead the vehicle 112 on the converged route section 906), then the time of the convergence event may be delayed such that the following vehicle 112 can slow down to allow the leading vehicle 110 to pull onto the converged route section 906 ahead of the following vehicle 112. Slowing the following vehicle 112 may result in fuel savings while avoiding decreasing the throughput parameter of the network 102. As another example, if the following vehicle 112 is traveling to arrive at the convergence point 906 before the leading vehicle 110, then the order of the vehicles 110, 112 may be switched. For example, the following vehicle 112 may proceed to enter onto the converged route section 906 ahead of the leading vehicle 110 and the following vehicle 112 may lead the leading vehicle 110 along the converged route section 906.

In order to modify the time of the convergence event to an updated time, the modification module 208 (shown in FIG. 2) of the scheduling system 100 (shown in FIG. 1) determines a confidence parameter that changing the time of the convergence event does not negatively impact the throughput parameter of the transportation network 102 (shown in FIG. 1). For example, the modification module 208 determines the probability that changing a scheduled time of the convergence event for the leading vehicle 110 and/or the following vehicle 112 will not decrease the throughput parameter of the transportation network 102.

If the confidence parameter determined by the modification module 208 (shown in FIG. 2) is sufficiently high, the modification module 208 can delay the original time of the convergence event to an updated or delayed time. The relatively high confidence parameter can indicate that modifying the time of the convergence event will not negatively impact the throughput parameter of the transportation network 102 (shown in FIG. 1). On the other hand, if the confidence parameter is too low, then the confidence parameter can indicate that modifying the time of the convergence event may negatively impact the throughput parameter.

The confidence parameter may be based on a closing distance between one or more of the vehicles 110, 112 and the location of the convergence event. The "closing distance" can mean the distance between a current location of a vehicle 110, 112 and the convergence point 906. The confidence parameter may be inversely related to the closing distance between the leading vehicle 110 and the convergence point 906 and/or the closing distance between the following vehicle 112 and the convergence point 906. For example, the confidence parameter may be smaller for a larger closing distance but may increase as the closing distance decreases. The confidence parameter may be inversely related to the closing distance because, as the vehicle 110 and/or 112 is farther from the location of the convergence event, there can be a greater possibility or chance that one or more of the vehicles 110, 112 has additional scheduled or unscheduled delays in arriving at the convergence event.

Similar to as described above, the modification module 208 (shown in FIG. 2) can compare the confidence parameter to one or more predetermined confidence thresholds to determine if the scheduled time of the convergence event can be changed to an updated time. For example, the modification module 208 may examine the confidence parameter to determine if the time of the convergence event can be delayed without adversely impacting the throughput parameter of the transportation network 102. In one embodiment, if the confidence parameter exceeds the confidence threshold, then the confidence parameter may indicate that the convergence event can be modified, such as by delaying the scheduled time of the convergence event. On the other hand, if the confidence parameter does not exceed the confidence threshold, then the confidence parameter may indicate that the convergence event cannot be modified without decreasing the throughput parameter of the transportation network 102.

If the confidence parameter exceeds the confidence threshold, then the modification module 208 (shown in FIG. 2) changes the originally scheduled time of the convergence event to an updated time. The updated time may be based on an ETA of the leading vehicle 110, an ETA of the following vehicle 112, and/or a predetermined slack time period, among other factors. The ETA of the vehicle 110 or 112 represents the estimated or calculated time before the vehicle 110 or 112 will arrive at the convergence event, such as by passing through the convergence point 106. The slack time period may be a scheduled period of time between arrival of the leading vehicle 110 at the location of the convergence event and arrival of the following vehicle 112 at the convergence event. The modification module 208 can delay the scheduled time of the convergence event by an amount of time that results in the leading vehicle 110 arriving at the convergence event by at least the slack time period before the following vehicle 112 arrives at the convergence event. In another embodiment, the confidence parameters calculated by the modification module 208 may be adjusted based on one or more unscheduled conditions, similar to as described above in connection with the meet events.

The modification module 208 communicates the updated convergence event to the communication module 210. The communication module 210 determines which vehicles 108, 110, 112 in the transportation network 102 are to receive the updated time of the updated convergence event. The communication module 210 transmits the updated convergence event to the appropriate vehicle 108, 110, 112, as described above. The corresponding vehicles 108, 110, 112 receive the updated convergence event and may change operations in response thereto. For example, control units (e.g., control unit 712 shown in FIG. 6) disposed on-board one or more of the vehicles 108, 110, 112 may reduce tractive efforts to slow down and to arrive at the updated convergence event at the updated time. In one embodiment, one or more of the vehicles 108, 110, 112 receive the updated convergence event and the energy management system 120 in the vehicles 108, 110, 112 that receive the updated convergence event examine the updated convergence event to determine if the tractive effort and/or braking effort of the vehicle 108, 110, 112 should be changed based on the updated convergence event, similar to as described above. The energy management system 120 may determine that the corresponding vehicle 108, 110, 112 can slow down or reduce speed and conserve fuel in order to arrive at the updated convergence event.

Delaying the time of a convergence event can reduce the fuel consumed by a following vehicle 112 that will arrive at the convergence event before a leading vehicle 110. For example, instead of stopping movement, waiting for the leading vehicle 110 to arrive at the convergence event, and then re-starting movement to move to the converged route section 904, the following vehicle 112 may slow down as the following vehicle 112 approaches the convergence event. The following vehicle 112 may start slowing sufficiently far from the convergence event that the following vehicle 112 does not need to come to a complete stop to allow the leading vehicle 110 to pull onto the converged route section 906 ahead of the following vehicle 112. The slowing down of the following vehicle 112 may reduce the amount of fuel consumed by the following vehicle 112.

In another embodiment, the vehicles 110, 112 may be traveling on the converged route section 904 toward the separate route sections 900, 902. For example, instead of the vehicles 110, 112 converging onto the same route section 904, the vehicles 110, 112 may be diverging onto different route sections 900, 902. The movement plan for the transportation network 102 may include a scheduled divergence event that includes scheduled times and a scheduled location for the divergence event. The times of the divergence event may be the times that each of the vehicles 110, 112 is to proceed from the converged route section 904 to the divergent route sections 900, 902. The location for the divergence event may be the geographic location of the convergence point 906. The vehicle 110 or 112 that is ahead of the other vehicle 112 or 110 heading toward the divergent route sections 900, 902 may be referred to as the leading vehicle and the other vehicle may be referred to as the following vehicle.

A divergence event between the vehicles 110, 112 may be modified by the scheduling system 100 (shown in FIG. 1) to conserve fuel or other energy consumed by the vehicles 110, 112. For example, the scheduled time of the divergence event can be modified to an updated time. In one embodiment, if the following vehicle is traveling faster than the leading vehicle and will arrive at the convergence point 906 before the leading vehicle, then the time of the divergence event may be delayed for the following vehicle such that the following vehicle can slow down to avoid colliding with the leading vehicle or to avoid coming too close (e.g., within a safety buffer distance of the leading vehicle). Slowing the following vehicle may result in fuel savings.

In order to modify the time of the divergence event to an updated time, the modification module 208 (shown in FIG. 2) of the scheduling system 100 (shown in FIG. 1) determines a confidence parameter that changing the time of the convergence event does not negatively impact the throughput parameter of the transportation network 102 (shown in FIG. 1). For example, the modification module 208 determines the probability that changing a scheduled time of the convergence event will not decrease the throughput parameter of the transportation network 102. If the confidence parameter determined by the modification module 208 (shown in FIG. 2) is sufficiently high, the modification module 208 can delay the original time of the convergence event to an updated or delayed time. On the other hand, if the confidence parameter is too low, then the confidence parameter can indicate that modifying the time of the divergence event may negatively impact the throughput parameter.

The confidence parameter may be based on a closing distance between one or more of the vehicles 110, 112 and the location of the divergence event. The confidence parameter may be inversely related to the closing distance between the leading vehicle and the convergence point 906 and/or the closing distance between the following vehicle and the convergence point 906. The confidence parameter may be inversely related to the closing distance because, as the vehicle and/or is farther from the location of the divergence event, there can be a greater possibility or chance that one or more of the vehicles 110, 112 has additional scheduled or unscheduled delays in arriving at the divergence event.

Similar to as described above, the modification module 208 (shown in FIG. 2) can compare the confidence parameter to one or more predetermined confidence thresholds to determine if the scheduled time of the convergence event can be changed to an updated time. For example, the modification module 208 may examine the confidence parameter to determine if the time of the divergence event can be delayed without adversely impacting the throughput parameter of the transportation network 102. In one embodiment, if the confidence parameter exceeds the confidence threshold, then the confidence parameter may indicate that the divergence event can be modified, such as by delaying the scheduled time of the divergence event for the following vehicle. On the other hand, if the confidence parameter does not exceed the confidence threshold, then the confidence parameter may indicate that the divergence event cannot be modified without decreasing the throughput parameter of the transportation network 102.

If the confidence parameter exceeds the confidence threshold, then the modification module 208 (shown in FIG. 2) changes the originally scheduled time of the convergence event to an updated time. The updated time may be based on an ETA of the leading vehicle, an ETA of the following vehicle, and/or a predetermined slack time period, among other factors. The ETA of the vehicle 110 or 112 represents the estimated or calculated time before the vehicle 110 or 112 will arrive at the divergence event, such as by passing through the convergence point 106. The slack time period may be a scheduled period of time between arrival of the leading vehicle at the location of the divergence event and arrival of the following vehicle at the divergence event. The modification module 208 can delay the scheduled time of the divergence event by an amount of time that results in the leading vehicle arriving at the divergence event by at least the slack time period before the following vehicle arrives at the divergence event.

The modification module 208 communicates the updated divergence event to the communication module 210. The communication module 210 determines which vehicles 108, 110, 112 in the transportation network 102 are to receive the updated time of the updated divergence event. The communication module 210 transmits the updated divergence event to the appropriate vehicle 108, 110, 112, as described above. The corresponding vehicles 108, 110, 112 receive the updated divergence event and may change operations in response thereto. For example, control units (e.g., control unit 712 shown in FIG. 6) disposed on-board one or more of the vehicles 108, 110, 112 may reduce tractive efforts to slow down and to arrive at the updated divergence event at the updated time. In one embodiment, one or more of the vehicles 108, 110, 112 receive the updated divergence event and the energy management system 120 in the vehicles 108, 110, 112 that receive the updated divergence event examine the updated convergence event to determine if the tractive effort and/or braking effort of the vehicle 108, 110, 112 should be changed based on the updated divergence event, similar to as described above. The energy management system 120 may determine that the corresponding vehicle 108, 110, 112 can slow down or reduce speed and conserve fuel in order to arrive at the updated divergence event.

Figure 7:
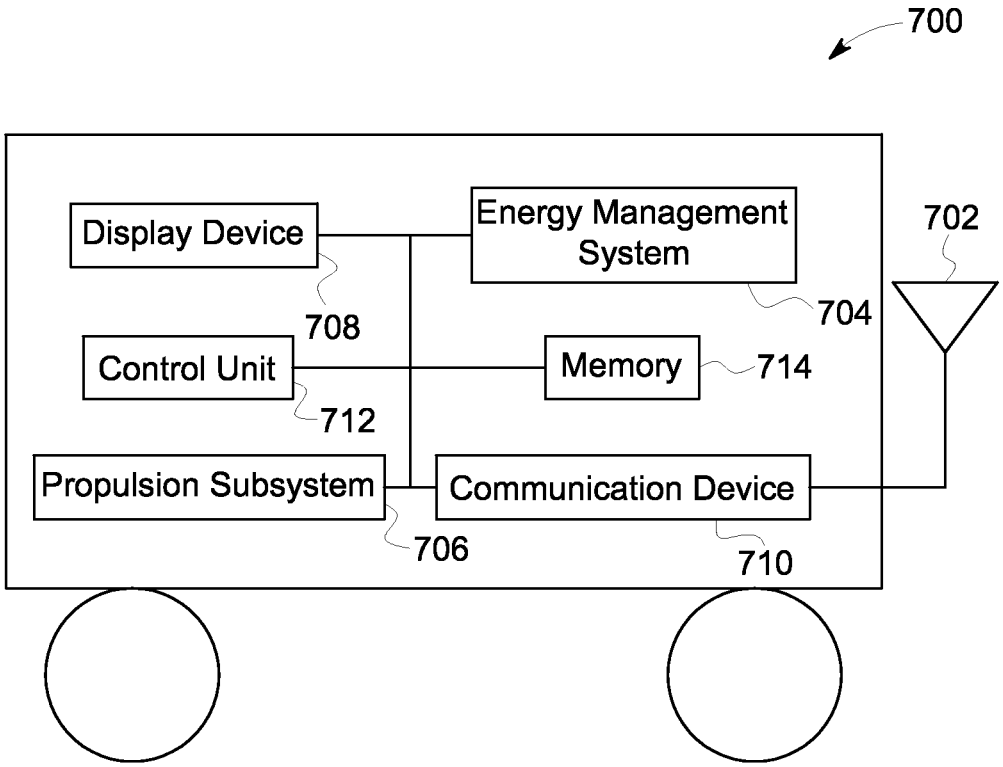
FIG. 7 is a schematic illustration of a powered rail vehicle in accordance with one embodiment.

FIG. 7 is a schematic illustration of a powered rail vehicle 700 in accordance with one embodiment. The powered rail vehicle 700 may represent one or more of the powered rail vehicles 126 (shown in FIG. 1) of the vehicles 108, 110, 112 (shown in FIG. 1). The powered rail vehicle 700 includes an antenna 702 that may be similar to the antenna 118 (shown in FIG. 1), an energy management system 704 that may be similar to the energy management system 120 (shown in FIG. 1), a propulsion subsystem 706 that may be similar to the propulsion subsystem 122 (shown in FIG. 1), and a display device 708 that may be similar to the display device 124 (shown in FIG. 1).

In the illustrated embodiment, the powered rail vehicle 700 includes a communication device 710 that is communicatively coupled with the antenna 702 for communicating data with off-board components. For example, the communication device 710 can include a transceiver device that wirelessly transmits and receives data messages, such as updated meet events from the scheduling system 100 (shown in FIG. 1). The communication device 710 conveys the data to one or more of the display device 708 for presentation of the data to the operator of the powered rail vehicle 700, to the energy management system 704 for use in determining tractive efforts and/or braking efforts to be provided by the powered rail vehicle 700, to a computer readable storage medium ("memory 714") of the powered rail vehicle 700, and/or to a control unit 712 of the powered rail vehicle 700.

The memory 714 may include a tangible and non-transitory computer readable storage medium, such as a computer hard drive, flash drive, RAM, ROM, EEPROM, and the like. The memory 714 can include one or more sets of instructions that direct the control unit 712 to perform various operations or steps. For example, the memory 714 can include software applications.

The control unit 712 may represent a hardware and/or software system that operates to perform one or more functions to control operations of the powered rail vehicle 700. For example, the control unit 712 may include one or more computer processors, controllers, or other logic-based devices that perform operations based on instructions stored on a tangible and non-transitory computer readable storage medium, such as the memory 714, for controlling tractive efforts and/or braking efforts of the powered rail vehicle 700. Alternatively, the control unit 712 may include a hard-wired device that performs operations based on hard-wired logic of the device. The control unit 712 shown in FIG. 7 may represent the hardware that operates based on software or hard-wired instructions, the software that directs hardware to perform the operations, or a combination thereof.

The control unit 712 can receive data messages from the scheduling system 100 (shown in FIG. 1) via the communication device 710 and use information included in the data messages to control or change tractive efforts and/or braking efforts of the powered rail vehicle 700 based on the information. For example, the control unit 712 may receive an updated location and/or an updated time of a meet event and/or a pass event. The received updated location and/or updated time may be the updated location and/or updated time for the powered rail vehicle 700 or another powered rail vehicle. For example, the powered rail vehicle 700 may be a passing or yielding vehicle in an updated meet event, or a leading or overtaking vehicle in an updated pass event, and the powered rail vehicle 700 may receive the updated location and/or updated time for the updated meet event or the updated pass event for the passing vehicle, the yielding vehicle, the leading vehicle, and/or the overtaking vehicle.

The control unit 712 may use the updated location and/or updated time to change a speed of the powered rail vehicle 700 to arrive at the updated meet event or the updated pass event. For example, if the powered rail vehicle 700 is the yielding vehicle at the updated meet event and the powered rail vehicle 700 is running ahead of schedule or the updated location is closer to a current location of the powered rail vehicle 700 than an original location of the meet event, the control unit 712 may use the updated location and/or updated time to reduce the speed of the powered rail vehicle 700. As another example, if the powered rail vehicle 700 is the passing vehicle at the updated meet event and a yielding vehicle is running behind schedule, the control unit 712 may use the updated location and/or updated time to reduce the speed of the powered rail vehicle 700. The speed may be reduced such that the passing vehicle arrives at the meet event at a later time such that the yielding vehicle has sufficient time to pull off of the main line route 104. As another example, the powered rail vehicle 700 may use the updated location and/or updated time to reduce the speed of the powered rail vehicle 700 as the vehicle 700 approaches the updated pass event.

The control unit 712 may calculate a difference in speed based on the updated location and/or updated time that the powered rail vehicle 700 needs to slow down in order to arrive at the updated meet event or updated pass event at the updated location and/or updated time. The control unit 712 may then direct the propulsion subsystem 706 to reduce speed to arrive at the updated event at the updated location and/or updated time. The control unit 712 may change the speed of the powered rail vehicle 700 such that the vehicle that includes the powered rail vehicle 700 arrives at the updated event later than the vehicle would have originally arrived at the event prior to changing the speed.

In one embodiment, the energy management system 704 conveys the trip plan that is formed for a vehicle that includes the powered rail vehicle 700 to the control unit 712. As described above, the trip plan may be formed based on a trip profile for the vehicle and may dictate tractive efforts and/or braking efforts for different portions of the trip. The energy management system 704 may update the trip plan when an updated location and/or updated time is received from the scheduling system 100 (shown in FIG. 1). For example, if an updated location and/or updated time is received from the scheduling system 100, then the energy management system 704 may revise the trip plan to require lower speed and/or tractive efforts from the powered rail vehicles in the vehicle to arrive at a later time for the updated event than the original time and/or to arrive at a closer location for the updated meet event than the original location.

The control unit 712 can receive the updated or revised trip plan from the energy management system 704 and adjust the tractive effort and/or braking effort of the propulsion subsystem 706 accordingly. For example, if the updated trip plan dictates that a lower speed is to be used to arrive at the updated meet event, then the control unit 712 can direct the propulsion subsystem 706 to reduce the tractive effort provided by the propulsion subsystem 706.

Figure 8:
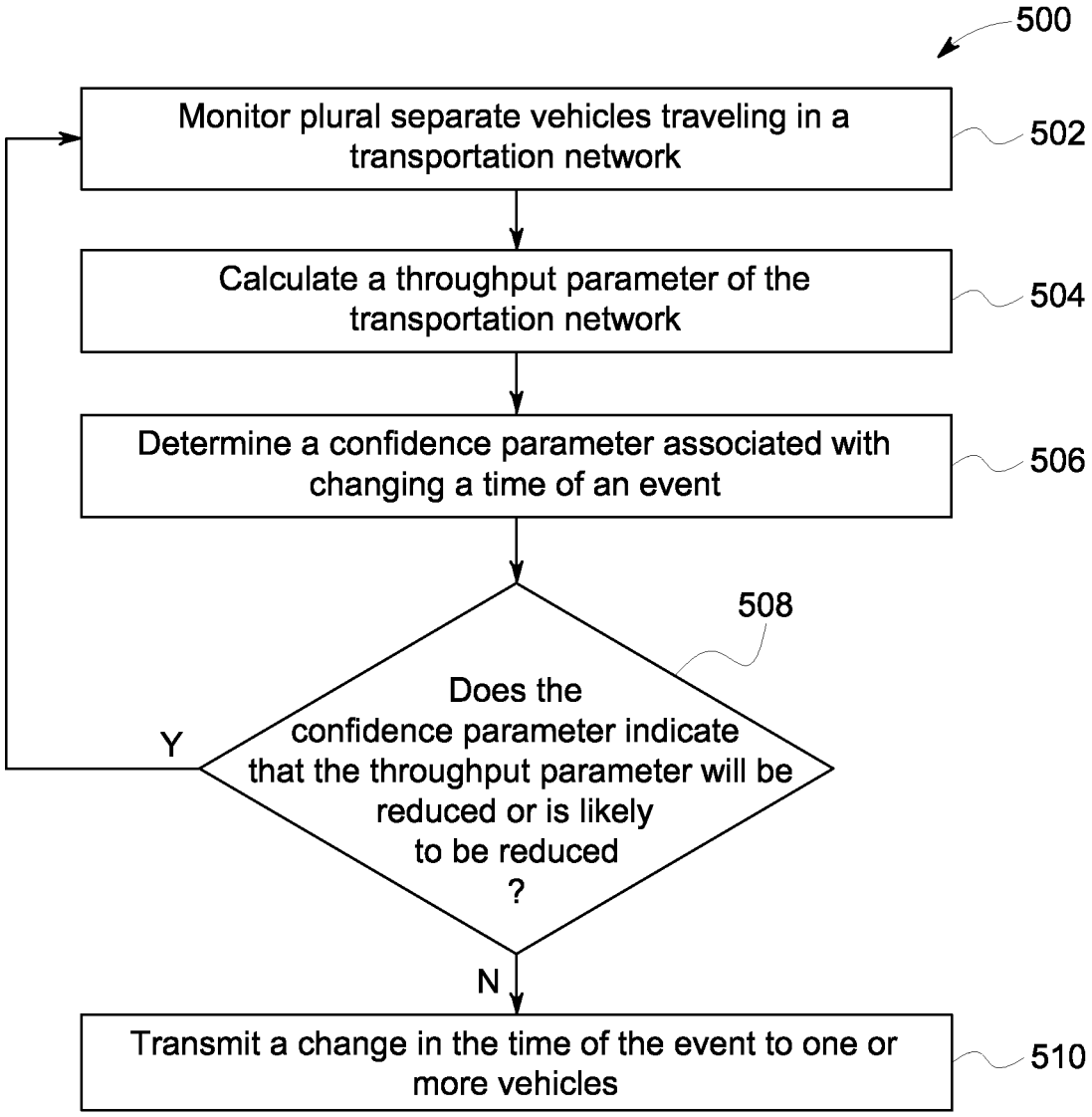
FIG. 8 is a flowchart of one embodiment of a method for adjusting a movement plan of a transportation network.

FIG. 8 is a flowchart of one embodiment of a method 500 for adjusting a movement plan of a transportation network. The method 500 may be used by the scheduling system 100 (shown in FIG. 1) to change a time of an event, such as a meet event, a pass event, a divergence event, and/or a convergence event of the movement plan for at least one of the vehicles 108, 110, 112 (shown in FIG. 1) moving in the transportation network 102 (shown in FIG. 1). As described above, the vehicles 108, 110, 112 may be moving in the transportation network 102 according to different schedules associated with the vehicles 108, 110, 112.

At 502, two or more of the vehicles 108, 110, 112 (shown in FIG. 1) traveling in the transportation network 102 (shown in FIG. 1) are monitored. For example, the locations of the vehicles 108, 110, 112 may be tracked over time. The vehicles 108, 110, 112 can periodically or continually transmit the respective locations of the vehicles 108, 110, 112 to the scheduling system 100 (shown in FIG. 1).

At 504, a throughput parameter of the transportation network 102 (shown in FIG. 1) is calculated. The throughput parameter can represent one or more rates of successful adherence by the vehicles 108, 110, 112 (shown in FIG. 1) to the movement plan. For example, if several vehicles 108, 110, 112 are traveling behind schedule, then the throughput parameter may have a lower value. Conversely, if more of the vehicles 108, 110, 112 are traveling on or ahead of schedule, then the throughput parameter may have a greater value. The calculation of the throughput parameter may occur at the same time that one or more of the vehicles 108, 110, 112 are traveling in the network 102.

At 506, one or more confidence parameters associated with changing a time of an event, such as a meet event, a pass event, a convergence event, and/or a divergence event, between two or more of the vehicles 108, 110, 112 (shown in FIG. 1) is determined. For example, a confidence parameter associated with delaying a time that the yielding vehicle 110 is scheduled to arrive at a meet event may be calculated. Alternatively, a confidence parameter associated with delaying a time that the passing vehicle 112 is scheduled to arrive at the meet event may be calculated. In another example, a confidence parameter associated with delaying a time that an overtaking vehicle 112 is scheduled to arrive at a pass event is calculated. Alternatively, a confidence parameter associated with delaying a time that a leading vehicle 110 is scheduled to arrive at the pass event is calculated. Alternatively, a confidence parameter associated with delaying a time that a following vehicle 112 is scheduled to arrive at a convergence event or a divergence event is calculated.

As described above, the confidence parameters represent a possibility or probability that changing the original time of the event to an updated time for at least one of the vehicles 108, 110, 112 will not reduce or significantly reduce the throughput parameter of the transportation network 102 (shown in FIG. 1). The confidence parameter may be adjusted based on unscheduled conditions, such as damaged portions of the transportation network 102 (shown in FIG. 1), previously unscheduled higher priority rail vehicles traveling in the transportation network 102, and the like.

At 508, the confidence parameter is examined to determine if the confidence parameter indicates that changing the original time of the event to an updated time will reduce or is likely to reduce the throughput parameter of the transportation network 102 (shown in FIG. 1). As described above, greater confidence parameters may indicate that changing the time of the event will not reduce or is unlikely to reduce the throughput parameter of the transportation network 102. Smaller confidence parameters may indicate that changing the time of the event will reduce or is likely to reduce the throughput parameter of the transportation network 102.

In one embodiment, the confidence parameter is compared to a threshold. If the confidence parameter exceeds the threshold, then the confidence parameter may indicate that changing the time of the event will not reduce or is unlikely to reduce the throughput parameter of the transportation network 102 (shown in FIG. 1). As a result, flow of the method 500 proceeds to 510. On the other hand, if the confidence parameter does not exceed the threshold, then the confidence parameter may indicate that changing the time of the event will reduce or is likely to reduce the throughput parameter of the transportation network 102. As a result, flow of the method 500 returns to 502. For example, the method 500 can loop back and return to monitoring the vehicles 108, 110, 112 (shown in FIG. 1) and calculating additional confidence parameters to determine if the times of any other meet events, pass events, convergence events, and/or divergence events can be changed without a significant risk to decreasing the network throughput of the transportation network 102.

At 510, the change in the time of the event is transmitted to one or more of the vehicles 108, 110, 112 (shown in FIG. 1). For example, the updated time of the meet event, the pass event, the convergence event, and/or the divergence event may be wirelessly transmitted to the vehicle 108, 110, 112 that arrives at the event at the updated time instead of at the previously scheduled, original time. As described above, the vehicles 108, 110, 112 may receive the updated times and, as a result, reduce the speed or tractive effort of the vehicle 108, 110, 112 to arrive at the location of the event at the updated time. Reducing the speed of the vehicle 108, 110, 112 can decrease fuel consumption of the vehicle 108, 110, 112 without having a significant negative impact on the throughput parameter of the transportation network 102 (shown in FIG. 1).

Figure 9:
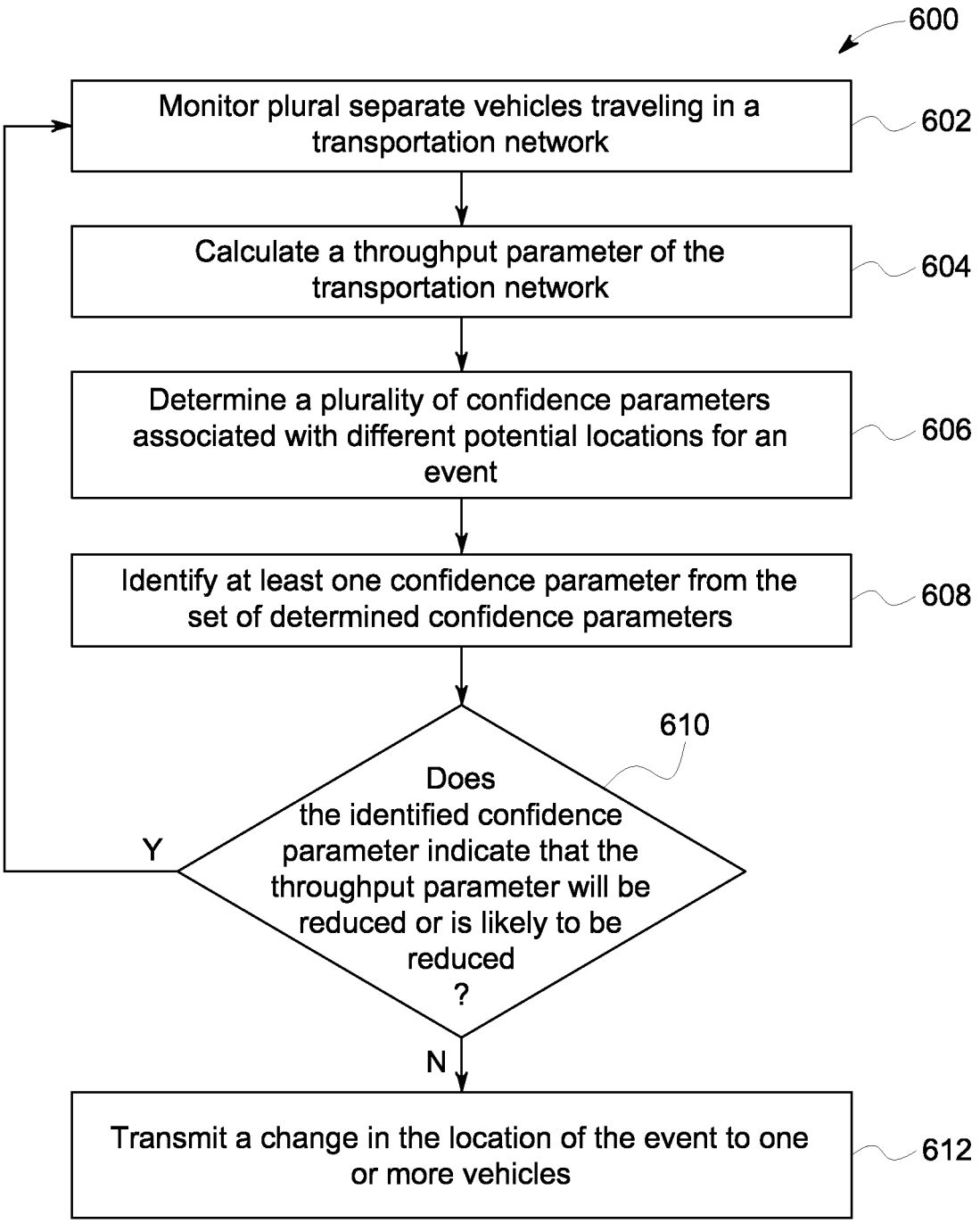
FIG. 9 is a flowchart of one embodiment of another method for adjusting a movement plan of a transportation network.

FIG. 9 is a flowchart of one embodiment of another method 600 for adjusting a movement plan of a transportation network. In one embodiment, the method 600 may be used by the scheduling system 100 (shown in FIG. 1) to change a location of meet event or a location of a pass event of the movement plan for the vehicles 108, 110, 112 (shown in FIG. 1) moving in the transportation network 102 (shown in FIG. 1).

At 602, two or more of the vehicles 108, 110, 112 (shown in FIG. 1) traveling in the transportation network 102 (shown in FIG. 1) are monitored. For example, the locations of the vehicles 108, 110, 112 may be tracked over time. The vehicles 108, 110, 112 can periodically or continually transmit the respective locations of the vehicles 108, 110, 112 to the scheduling system 100 (shown in FIG. 1).

At 604, a throughput parameter of the transportation network 102 (shown in FIG. 1) is calculated. The throughput parameter can represent one or more rates of successful adherence by the vehicles 108, 110, 112 (shown in FIG. 1) to the movement plan, as described above. The calculation of the throughput parameter can occur at the same time that the vehicles 108, 110, 112 travel through the network 102.

At 606, two or more confidence parameters associated with different potential locations for an event, such as a meet event or a pass event, are determined. For example, several confidence parameters each associated with a different siding section route 106 (shown in FIG. 1) between the yielding vehicle 110 (shown in FIG. 1) and the passing vehicle 112 (shown in FIG. 1) may be calculated. In one embodiment, a confidence parameter also is determined for the originally scheduled location of the meet event. The confidence parameters that are calculated for the siding section routes 106 located between the yielding and passing vehicles 110, 112 may be referred to as a set of potential locations for the event (e.g., the meet event or the pass event).

Each of the confidence parameters in the set can represent a possibility or probability that using the associated location of the siding section route 106 (shown in FIG. 1) for a meet event or a pass event between two different vehicles (e.g., the yielding vehicle and the passing vehicle for a meet event, or the leading vehicle and the overtaking vehicle for the pass event) will not reduce or significantly reduce the throughput parameter of the transportation network 102 (shown in FIG. 1). One or more of the confidence parameters can be adjusted based on unscheduled conditions, such as damaged portions of the transportation network 102 (shown in FIG. 1), previously unscheduled higher priority rail vehicles traveling in the transportation network 102, and the like.

At 608, at least one of the confidence parameters in the set is identified. The identified confidence parameter may be selected based on a comparison among the confidence parameters in the set. In one embodiment, the confidence parameter that is greater than one or more or all of the other confidence parameters in the set is identified. Alternatively, another confidence parameter is identified.

At 610, the identified confidence parameter from the set is examined to determine if the identified confidence parameter indicates that changing the original location of the event to an updated location will reduce or is likely to reduce the throughput parameter of the transportation network 102 (shown in FIG. 1). As described above, greater confidence parameters may indicate that changing the location of the event will not reduce or is unlikely to reduce the throughput parameter of the transportation network 102. Smaller confidence parameters may indicate that changing the location of the event will reduce or is likely to reduce the throughput parameter of the transportation network 102.

In one embodiment, the identified confidence parameter is compared to a threshold. If the identified confidence parameter exceeds the threshold, then the identified confidence parameter may indicate that changing the location of the event to another siding section route 106 (shown in FIG. 1) will not reduce or is unlikely to reduce the throughput parameter of the transportation network 102 (shown in FIG. 1). As a result, flow of the method 600 proceeds to 612. On the other hand, if the identified confidence parameter does not exceed the threshold, then the identified confidence parameter may indicate that changing the location of the event will reduce or is likely to reduce the throughput parameter of the transportation network 102. As a result, flow of the method 600 returns to 602. The method 600 can loop back and return to monitoring the vehicles 108, 110, 112 (shown in FIG. 1) and calculating additional confidence parameters to determine if the locations of any other meet events and/or pass events can be changed without a significant risk to decreasing the network throughput of the transportation network 102.

At 612, the change in the location of the event is transmitted to one or more of the vehicles 108, 110, 112 (shown in FIG. 1). For example, the GPS coordinates of the updated location of the event may be wirelessly transmitted to the vehicles 108, 110, 112 that participate in the event (e.g., the yielding and passing vehicles for a meet event, or the leading and overtaking vehicles for a pass event). In one embodiment, the updated location of the event may be closer to one of the yielding or passing vehicles 110, 112 and may allow the yielding or passing vehicle 110, 112 to reduce speed or tractive effort. Reducing the speed of the vehicle 110, 112 can decrease fuel consumption of the vehicle 110, 112 without having a significant negative impact on the throughput parameter of the transportation network 102 (shown in FIG. 1).

While the methods 500, 600 shown in FIGS. 7 and 8 are separately described, the methods 500, 600 may be used in conjunction with each other. For example, the scheduling system 100 (shown in FIG. 1) may employ both methods 500, 600 to determine whether to change the times and/or locations of the one or more events between various plural vehicles 108, 110, 112 (shown in FIG. 1) can be changed to reduce speeds and fuel consumption of the vehicles 108, 110, 112 without significantly negatively impacting the throughput parameter of the transportation network 102 (shown in FIG. 1). The scheduling system 100 can monitor the vehicles 108, 110, 112 and modify the times and/or locations of the events in real-time. By "real-time," it is meant that the scheduling system 100 can change the times and/or locations of one or more events as the yielding and passing vehicles 110, 112 in each of the events are moving toward or approaching the respective events.

In one embodiment, a system (e.g., an off-board scheduling system) includes a monitoring module, a congestion module, a modification module, and a communication module. The monitoring module is configured to monitor plural separate vehicles traveling in a transportation network according to a movement plan of the network. The movement plan directs the vehicles to move through the network according to schedules associated with the separate vehicles and includes an original meet event between a yielding vehicle and a passing vehicle of the separate vehicles. The congestion module is configured to calculate a throughput parameter of the network that is representative of a statistical measure of adherence to the movement plan by the separate vehicles. The modification module is configured to determine a confidence parameter representative of a probability that changing the original meet event does not reduce the throughput parameter of the network. The modification module also is configured to modify the original meet event to an updated meet event when the confidence parameter exceeds a predetermined threshold. The communication module is configured to transmit the updated meet event to one or more of the yielding vehicle or the passing vehicle as at least one of the yielding vehicle or the passing vehicle is moving toward the original meet event, for the one or more of the yielding vehicle or the passing vehicle to receive the updated meet event from the communication module and change a speed of the yielding vehicle or the passing rail vehicle to arrive at the updated meet event.

In another aspect, the communication module is configured to transmit a plurality of the updated meet events to two or more of the plural separate vehicles.

In another aspect, the original meet event is associated with at least one of an original location or an original time of the original meet event, and the updated meet event is associated with at least one of an updated location that differs from the original location or an updated time that differs from the original time for the updated meet event to occur.

In another aspect, for the updated meet event, the yielding vehicle is configured to move from a main line track in the network to a connected siding section track in the network and the passing vehicle is configured to continue along and pass the yielding vehicle on the main line track at at least one of a location or a time of the updated meet event.

In another aspect, the monitoring module is configured to track at least one of a current location of the yielding vehicle or a current location of the passing vehicle. The modification module also is configured to determine the confidence parameter based on a remaining distance between an original location of the original meet event and the at least one of the current location of the yielding vehicle or the current location of the passing vehicle.

In another aspect, the modification module is configured to calculate the confidence parameter based on an inverse relationship between the confidence parameter and the remaining distance.

In another aspect, the network includes a plurality of potential locations for the updated meet event disposed between the yielding vehicle and the passing vehicle. The modification module is configured to calculate the confidence parameter based on a number of the potential locations disposed between at least one of the yielding vehicle or the passing vehicle and the original location of the meet event.

In another aspect, the modification module is configured to calculate the confidence parameter such that the confidence parameter decreases as the number of the potential locations between the at least one of the yielding vehicle or the passing vehicle and an original location of the original meet event increases.

In another aspect, the modification module is configured to determine the confidence parameter for each of the plurality of potential locations for the updated meet event. The modification module is configured to change an original location of the original meet event to an updated location based on a comparison between the confidence parameters determined for the plurality of potential locations.

In another aspect, the communication module is configured to transmit at least one of the updated location or the updated time to one or more of the yielding vehicle or the passing vehicle for an energy management system disposed on-board the yielding vehicle or the passing vehicle to modify the speed of the yielding vehicle or the passing vehicle based on the at least one of an updated location or an updated time of the updated meet event.

In another aspect, the modification module is configured to delay arrival of the yielding vehicle at the original meet event when the passing vehicle is traveling to arrive at the original meet event later than an originally scheduled time of the original meet event.

In another aspect, the modification module is configured to delay arrival of the passing vehicle at the original meet event when the yielding vehicle is traveling to pull off a main line route onto a siding section route after an originally scheduled time of the original meet event.

In another embodiment, a method (e.g., a method for adjusting a movement plan of a transportation network) is provided that includes monitoring plural separate vehicles traveling in the transportation network according to a movement plan of the network. The movement plan directs the vehicles to move through the network according to schedules associated with the separate vehicles. The movement plan includes an original meet event between a yielding vehicle and a passing vehicle of the separate vehicles. The method also includes determining a throughput parameter of the network that is representative of a statistical measure of adherence to the movement plan by the separate vehicles, determining a confidence parameter representative of a probability that changing at least one of an original location or an original time of the original meet event does not reduce the throughput parameter of the network, modifying at least one of the original location or the original time of the original meet event to at least one of an updated location or an updated time of an updated meet event when the confidence parameter exceeds a predetermined threshold, and transmitting at least one of the updated location or the updated time to one or more of the yielding vehicle or the passing vehicle as at least one of the yielding vehicle or the passing vehicle is moving toward the location of the original meet event.

In another aspect, transmitting in the method includes transmitting the at least one of the updated location or the updated time for the one or more of the yielding vehicle or the passing vehicle to receive the at least one of the updated location or the updated time and change a speed of the yielding vehicle or the passing rail vehicle to arrive at the updated meet event.

In another aspect, monitoring includes tracking at least one of a current location of the yielding vehicle or a current location of the passing vehicle. The confidence parameter is based on a remaining distance between the original location of the original meet event and the at least one of the current location of the yielding vehicle or the current location of the passing vehicle.

In another aspect, the network includes a plurality of potential locations for the updated meet event disposed between the yielding vehicle and the passing vehicle. The confidence parameter is based on a number of the potential locations disposed between at least one of the yielding vehicle or the passing vehicle and the original location of the original meet event.

In another aspect, the confidence parameter decreases as the number of the potential locations between the at least one of the yielding vehicle or the passing vehicle and the original location of the original meet event increases.

In another aspect, the step of determining the confidence parameter includes determining the confidence parameter for each of the plurality of potential locations for the updated meet event, and the modifying step includes changing the original location of the original meet event to the updated location based on a comparison between the confidence parameters determined for the plurality of potential locations.

In another aspect, the transmitting step includes transmitting at least one of the updated location or the updated time to one or more of the yielding vehicle or the passing vehicle for an energy management system disposed on-board the yielding vehicle or the passing vehicle to modify the speed of the yielding vehicle or the passing vehicle based on the at least one of the updated location or the updated time.

In another aspect, modifying the at least one of the original location or the original time includes delaying arrival of the yielding vehicle at the original meet event when the passing vehicle is traveling to arrive at the original meet event later than the original time of the original meet event.

In another aspect, modifying the at least one of the original location or the original time includes delaying arrival of the passing vehicle at the original meet event when the yielding vehicle is traveling to pull off a main line route onto a siding section route after the original time of the original meet event.

In another embodiment, a computer readable storage medium for a system having a processor (e.g., an off-board scheduling system of a transportation network) is provided. The computer readable storage medium includes one or more sets of instructions configured to direct the processor to monitor plural separate vehicles traveling in the transportation network according to a movement plan of the network. The movement plan directs the vehicles to move through the network according to schedules associated with the separate vehicles. The movement plan includes an original meet event between a yielding vehicle and a passing vehicle of the separate vehicles. The one or more sets of instructions also are configured to direct the processor to determine a throughput parameter of the network that is representative of a statistical measure of adherence to the movement plan by the separate vehicles and determine a confidence parameter representative of a probability that changing at least one of an original location or an original time of the original meet event does not reduce the throughput parameter of the network. The one or more sets of instructions are further configured to direct the processor to modify at least one of the original location or the original time of the original meet event to at least one of an updated location or an updated time of an updated meet event when the confidence parameter exceeds a predetermined threshold and to transmit at least one of the updated location or the updated time to one or more of the yielding vehicle or the passing vehicle as at least one of the yielding vehicle or the passing vehicle is moving toward the location of the original meet event, for the one or more of the yielding vehicle or the passing vehicle to receive the at least one of the updated location or the updated time and change a speed of the yielding vehicle or the passing rail vehicle to arrive at the updated meet event.

In another aspect, the computer readable storage medium is a tangible and non-transitory (e.g., not a transient signal) computer readable storage medium.

In another aspect, the one or more sets of instructions direct the processor to track at least one of a current location of the yielding vehicle or a current location of the passing vehicle, and the confidence parameter is based on a remaining distance between the original location of the original meet event and the at least one of the current location of the yielding vehicle or the current location of the passing vehicle.

In another aspect, the network includes a plurality of potential locations for the updated meet event disposed between the yielding vehicle and the passing vehicle. The confidence parameter is based on a number of the potential locations disposed between at least one of the yielding vehicle or the passing vehicle and the original location of the original meet event.

In another aspect, the one or more sets of instructions are configured to direct the processor to determine the confidence parameter for each of the plurality of potential locations for the updated meet event and change the original location of the original meet event to the updated location based on a comparison between the confidence parameters determined for the plurality of potential locations.

In another aspect, the one or more sets of instructions are configured to direct the processor to transmit at least one of the updated location or the updated time to one or more of the yielding vehicle or the passing vehicle for an energy management system disposed on-board the yielding vehicle or the passing vehicle to modify the speed of the yielding vehicle or the passing vehicle based on the at least one of the updated location or the updated time.

In another embodiment, a method (e.g., a method for directing movement of vehicles in a transportation network) includes, at one of a yielding vehicle or a passing vehicle, receiving from an off-board scheduling system at least one of an updated location or an updated time of a meet event of the yielding vehicle and the passing vehicle and changing a speed of said one of the yielding vehicle or the passing vehicle in response to said at least one of the updated location or the updated time to arrive at the meet event.

In another aspect, changing the speed comprises slowing said one of the yielding vehicle or the passing vehicle to arrive at the meet event later than the yielding vehicle or the passing vehicle would have originally arrived at the meet event prior to changing the speed.

In another aspect, changing the speed comprises providing said at least one of the updated location or the updated time to an energy management system disposed on board said one of the yielding vehicle or the passing vehicle, revising by the energy management system of a trip plan of said one of the yielding vehicle or the passing vehicle based on said at least one of the updated location or the updated time to form a revised trip plan, and controlling movement of said one of the yielding vehicle or the passing vehicle based on the revised trip plan.

In another embodiment, a system (e.g., an on-board control system of a vehicle) includes a control unit that is configured to be disposed on-board a first vehicle and to receive from an off board scheduling system at least one of an updated location or an updated time of a meet event of the first vehicle and a second vehicle. The control unit is configured to change a speed of said first vehicle in response to said at least one of the updated location or the updated time to arrive at the meet event.

In another aspect, the control unit is configured to slow down said first vehicle to arrive at the meet event later than the first vehicle would have originally arrived at the meet event prior to changing the speed.

In another aspect, the system also includes an energy management system configured to be disposed on-board the first vehicle and to form a trip plan that dictates tractive efforts of the first vehicle based on a trip profile. The energy management system is configured to receive said at least one of the updated location or the updated time and revise the trip plan based on said at least one of the updated location or the updated time to form a revised trip plan. The control unit is configured to control movement of said first vehicle based on the revised trip plan.

In another embodiment, a system (e.g., an on-board system of a vehicle) includes a control unit for a first vehicle and a computer readable storage medium. The computer readable storage medium has one or more sets of instructions that are configured to direct the control unit to receive at least one of an updated location or an updated time of a meet event of the first vehicle and a second vehicle from an off-board scheduling system and change a speed of the first vehicle in response to said at least one of the updated location or the updated time to arrive at the meet event.

In another aspect, the computer readable storage medium is a tangible and non-transitory (e.g., not a transient signal).

In another aspect, the one or more sets of instructions are configured to direct the control unit to slow said first vehicle to arrive at the meet event later than the first vehicle would have originally arrived at the meet event prior to changing the speed.

In another aspect, the one or more sets of instructions are configured to direct the control unit to receive a revised trip plan that is formed by an energy management system based on said at least one of the updated location or the updated time. The trip plan dictates tractive efforts provided by said first vehicle based on a trip profile. The one or more sets of instructions are configured to direct the control unit to control movement of said first vehicle based on the revised trip plan.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A system comprising:

a monitoring module configured to monitor plural separate vehicles traveling in a transportation network according to a movement plan of the network, the separate vehicles including a yielding vehicle, a passing vehicle, and at least one other vehicle, the movement plan directing the separate vehicles to move through the network according to schedules associated with the separate vehicles, the movement plan including an original meet event between the yielding vehicle and the passing vehicle of the separate vehicles, the original meet event including the yielding vehicle of the separate vehicles being scheduled to move from a main line track in the network to a connected siding section track in the network and the passing vehicle of the separate vehicles being scheduled to continue moving along the main line track to pass the yielding vehicle at an original time and an original location of the original meet event;

a congestion module configured to calculate a throughput parameter of the network that is representative of a statistical measure of adherence to the movement plan by the yielding vehicle, the passing vehicle, and the at least one other vehicle, the throughput parameter indicating how closely the yielding vehicle, the passing vehicle, and the at least one other vehicle are traveling through the network according to the schedules associated with the yielding vehicle, the passing vehicle, and the at least one other vehicle in the movement plan;

a modification module configured to determine a confidence parameter representative of a probability that changing the original meet event does not reduce the throughput parameter of the yielding vehicle, the passing vehicle, and the at least one other vehicle traveling in the network, the modification module configured to modify the original meet event to an updated meet event when the confidence parameter exceeds a predetermined threshold, the updated meet event including the yielding vehicle being scheduled to move from the main line track to the connected siding section track at one or more of an updated time or an updated location, and the passing vehicle being scheduled to continue moving along, the main line track to pass the yielding vehicle at the one or more of the updated time or the updated location; and a communication module configured to transmit the updated meet event to one or more of the yielding vehicle or the passing vehicle as at least one of the yielding vehicle or the passing vehicle is moving toward the original meet event, for the one or more of the yielding vehicle or the passing vehicle to receive the updated meet event from the communication module and change a speed of the yielding vehicle or the passing rail vehicle to arrive at the updated meet event, wherein the monitoring module, the congestion module, the modification module, and the communication module include one or more processors.

2. The system of claim I, wherein the communication module is configured to transmit a plurality of the updated meet events to two or more of the plural separate vehicles.

3. The system of claim 1, wherein the original meet event is associated with at least one of an original location or an original time of the original meet event, and the updated meet event is associated with at least one of the updated location of the updated meet event that differs from the original location of the original meet event or the updated time of the updated meet event that differs from the original time of the original meet event.

4. The system of claim 1, wherein the monitoring module is configured to track at least one of a current location of the yielding vehicle or a current location of the passing vehicle, and the modification module is configured to determine the confidence parameter based on a remaining distance between an original location of the original meet event and the at least one of the current location of the yielding vehicle or the current location of the passing vehicle.

5. The system of claim 4, wherein the modification module is configured to calculate the confidence parameter based on an inverse relationship between the confidence parameter and the remaining distance.

6. The system of claim 1, wherein the network includes a plurality of potential locations for the updated meet event disposed between the yielding vehicle and the passing vehicle, and the modification module is configured to calculate the confidence parameter based on a number of the potential locations disposed between at least one of the yielding vehicle or the passing vehicle and the original location of the meet event.

7. The system of claim 6, wherein the modification module is configured to calculate the confidence parameter such that the confidence parameter decreases as the number of the potential locations between the at least one of the yielding vehicle or the passing vehicle and an original location of the original meet event increases.

8. The system of claim 6, wherein the modification module is configured to determine the confidence parameter for each of the plurality of potential locations for the updated meet event, and the modification module is configured to change an original location of the original meet event to the updated location based on a comparison between the confidence parameters determined for the plurality of potential locations.

9. The system of claim 1, wherein the communication module is configured to transmit at least one of the updated location or the updated time to one or more of the yielding vehicle or the passing vehicle for an energy management system disposed on-board the yielding vehicle or the passing vehicle to modify the speed of the yielding vehicle or the passing vehicle based on the at least one of an updated location or an updated time of the updated meet event.

10. The system of claim 1, wherein the modification module is configured to delay arrival of the yielding vehicle at the original meet event when the passing vehicle is traveling to arrive at the original meet event later than an originally scheduled time of the original meet event.

11. The system of claim 1, wherein the modification module is configured to delay arrival of the passing vehicle at the original meet event when the yielding vehicle is traveling to pull off a main line route onto a siding section route after an originally scheduled time of the original meet event.

12. A method comprising:

monitoring plural separate vehicles traveling in a transportation network according to a movement plan of the network using one or more processors, the separate vehicles including a yielding vehicle, a passing vehicle, and at least one other vehicle, the movement plan directing the separate vehicles to move through the network according to schedules associated with the separate vehicles, the movement plan including an original meet event between the yielding vehicle and the passing vehicle of the separate vehicles, the original meet event including the yielding vehicle of the separate vehicles being scheduled to move from a main line track in the network to a connected siding section track in the network and the passing vehicle of the separate vehicles being scheduled to continue moving along the main line track to pass the yielding vehicle at an original time and an original location of the original meet event;

determining a throughput parameter of the network using, the one or more processors, the throughput parameter representative of a statistical measure of adherence to the movement plan by the yielding vehicle, the passing vehicle, and at least one other vehicle, the throughput parameter indicating how closely the yielding vehicle, the passing vehicle, and at least one other vehicle are traveling through the network according to the schedules associated with the yielding vehicle, the passing vehicle, and at least one other vehicle in the movement plan;

determining a confidence parameter using the one or more processors, the confidence parameter representative of a probability that changing at least one of an original location or an original time of the original meet event does not reduce the throughput parameter of the yielding vehicle, the passing vehicle, and at least one other vehicle traveling in the network;

modifying at least one of the original location or the original time of the original meet event to at least one of an updated location or an updated time of an updated meet event when the confidence parameter exceeds a predetermined threshold using the one or more processors, the updated meet event including the yielding vehicle being scheduled to move from the main line track to the connected siding section track at one or more of the updated time or the updated location, and the passing vehicle being scheduled to continue moving along the main line track to pass the yielding vehicle at the one or more of the updated time or the updated location; and transmitting at least one of the updated location or the updated time to one or more of the yielding vehicle or the passing vehicle as at least one of the yielding vehicle or the passing vehicle is moving toward the location of the original meet event using the one or more processors.

13. The method of claim 12, wherein the at least one of the updated location or the updated time is transmitted for the one or more of the yielding vehicle or the passing vehicle to receive the at least one of the updated location or the updated time and to change a speed of the yielding vehicle or the passing rail vehicle to arrive at the updated meet event.

14. The method of claim 12, further comprising tracking at least one of a current location of the yielding vehicle or a current location of the passing vehicle, and the confidence parameter is based on a remaining distance between the original location of the original meet event and the at least one of the current location of the yielding vehicle or the current location of the passing vehicle.

15. The method of claim 12, wherein the network includes a plurality of potential locations for the updated meet event disposed between the yielding vehicle and the passing vehicle, and the confidence parameter is based on a number of the potential locations disposed between at least one of the yielding vehicle or the passing vehicle and the original location of the original meet event.

16. The method of claim 15, wherein the confidence parameter decreases as the number of the potential locations between the at least one of the yielding vehicle or the passing vehicle and the original location of the original meet event increases.

17. The method of claim 15, wherein the confidence parameter is determined for each of the plurality of potential locations for the updated meet event. and the original location of the original meet event is changed to the updated location based on a comparison between the confidence parameters determined for the plurality of potential locations.

18. The method of claim 12, wherein the at least one of the updated location or the updated time is transmitted to one or more of the yielding vehicle or the passing vehicle for an energy management system disposed on-board the yielding vehicle or the passing vehicle to modify the speed of the yielding vehicle or the passing vehicle based on the at least one of the updated location or the updated time.

19. The method of claim 12, wherein modifying the at least one of the original location or the original time includes delaying arrival of the yielding vehicle at the original meet event when the passing vehicle is traveling to arrive at the original meet event later than the original time of the original meet event.

20. The method of claim 12, wherein at least one of the original location or the original time is modified by delaying arrival of the passing vehicle at the original meet event when the yielding vehicle is traveling to pull off a main line route onto a siding section route after the original time of the original meet event.

21. A non-transitory computer readable storage medium for a system having one or more processors, the non-transitory computer readable storage medium including one or more sets of instructions that are configured to direct the one or more processors to:

monitor plural separate vehicles traveling in the transportation network according to a movement plan of the network, the separate vehicles including a yielding vehicle, a passing vehicle, and at least one other vehicle, the movement plan directing the separate vehicles to move through the network according to schedules associated with the separate vehicles, the movement plan including an original meet event between the yielding vehicle and the passing vehicle of the separate vehicles, the original meet event including the yielding vehicle of the separate vehicles being scheduled to move from a main line track in the network to a connected siding section track in the network and the passing vehicle of the separate vehicles being scheduled to continue moving along the main line track to pass the yielding vehicle at an original time and an original location of the original meet event;

determine a throughput parameter of the network that is representative of a statistical measure of adherence to the movement plan by the yielding vehicle, the passing vehicle, and at least one other vehicle, the throughput parameter indicating how closely the yielding vehicle, the passing vehicle, and at least one other vehicle are traveling through the network according to the schedules associated with the yielding vehicle, the passing vehicle, and at least one other vehicle in the movement plan;

determine a confidence parameter representative of a probability that changing at least one of the original location or the original time of the original meet event does not reduce the throughput parameter of the yielding vehicle, the passing vehicle, and at least one other vehicle traveling in the network;

modify at least one of the original location or the original time of the original meet event to at least one of an updated location or an updated time of an updated meet event when the confidence parameter exceeds a predetermined threshold, the updated meet event including the yielding vehicle being scheduled to move from the main line track to the connected siding section track at one or more of the updated time or the updated location, and the passing vehicle being scheduled to continue moving along the main line track to pass the yielding vehicle at the one or more of the updated time or the updated location; and transmit at least one of the updated location or the updated time to one or more of the yielding vehicle or the passing vehicle as at least one of the yielding vehicle or the passing vehicle is moving toward the location of the original meet event, for the one or more of the yielding vehicle or the passing vehicle to receive the at least one of the updated location or the updated time and change a speed of the yielding vehicle or the passing rail vehicle to arrive at the updated meet event.

22. The non-transitory computer readable storage medium of claim 21, wherein the one or more sets of instructions are configured to direct the one or more processors to track at least one of a current location of the yielding vehicle or a current location of the passing vehicle, and the confidence parameter is based on a remaining distance between the original location of the original meet event and the at least one of the current location of the yielding vehicle or the current location of the passing vehicle.

23. The non-transitory computer readable storage medium of claim 21, wherein the network includes a plurality of potential locations for the updated meet event disposed between the yielding vehicle and the passing vehicle, and the confidence parameter is based on a number of the potential locations disposed between at least one of the yielding vehicle or the passing vehicle and the original location of the original meet event.

24. The non-transitory computer readable storage medium of claim 23, wherein the one or more sets of instructions are configured to direct the one or more processors to:

determine the confidence parameter for each of the plurality of potential locations for the updated meet event; and change the original location of the original meet event to the updated location based on a comparison between the confidence parameters determined for the plurality of potential locations.

25. The non-transitory computer readable storage medium of claim 21, wherein the one or more sets of instructions are configured to direct the one or more processors to transmit at least one of the updated location or the updated time to one or more of the yielding vehicle or the passing vehicle for an energy management system disposed on-board the yielding vehicle or the passing vehicle to modify the speed of the yielding vehicle or the passing vehicle based on the at least one of the updated location or the updated time.

* * * * *